US010994316B2

(12) United States Patent
Min et al.

(10) Patent No.: US 10,994,316 B2
(45) Date of Patent: May 4, 2021

(54) STRAIGHTENING SYSTEM AND STRAIGHTENING METHOD

(71) Applicant: POSCO, Pohang-si (KR)

(72) Inventors: Gwan-Sik Min, Pohang-si (KR); Pil-Jong Lee, Pohang-si (KR); Seong-Hyun Ko, Pohang-si (KR); Hui-Seop Kwon, Pohang-si (KR); Seung-Woo Park, Pohang-si (KR); Jong-Hoon Kang, Pohang-si (KR); Jae-Hyung Seo, Pohang-si (KR)

(73) Assignee: POSCO, Pohang-si (KR)

( * ) Notice: Subject to any disclaimer, the term of this patent is extended or adjusted under 35 U.S.C. 154(b) by 316 days.

(21) Appl. No.: 16/064,436

(22) PCT Filed: Jul. 27, 2016

(86) PCT No.: PCT/KR2016/008230
§ 371 (c)(1),
(2) Date: Jun. 20, 2018

(87) PCT Pub. No.: WO2017/111243
PCT Pub. Date: Jun. 29, 2017

(65) Prior Publication Data

US 2018/0369887 A1 Dec. 27, 2018

(30) Foreign Application Priority Data

Dec. 23, 2015 (KR) ..... 10-2015-0184729
Dec. 23, 2015 (KR) ..... 10-2015-0184739

(51) Int. Cl.
*B21B 37/44* (2006.01)
*B21B 37/46* (2006.01)
(Continued)

(52) U.S. Cl.
CPC ..... *B21B 37/44* (2013.01); *B21B 37/46* (2013.01); *B21B 37/58* (2013.01); *B21B 37/74* (2013.01);
(Continued)

(58) Field of Classification Search
CPC ..... B21B 38/02; B21B 37/28; B21B 37/46; B21B 37/74; B21B 37/72; B21B 37/44; B21B 45/02
See application file for complete search history.

(56) References Cited

U.S. PATENT DOCUMENTS 4,011,743 A 3/1977 Peterson et al.
5,799,523 A 1/1998 Seidel et al.
(Continued)

FOREIGN PATENT DOCUMENTS

CN 1151914 A 6/1997
CN 101253007 A 8/2008
(Continued)

OTHER PUBLICATIONS

Extended European Search Report dated Jan. 4, 2019 issued in European Patent Application No. 16879111.9.
(Continued)

*Primary Examiner* — Debra M Sullivan
(74) *Attorney, Agent, or Firm* — Morgan, Lewis & Bockius LLP

(57) ABSTRACT

A straightening system is provided to perform straightening in conformity with a shape pattern of a the material. The straightening system includes a cooling device configured to spray a cooling fluid in a predetermined pattern with respect to a plurality of regions of the material, divided in a width direction, to cool the material that is heated in a heating furnace and then passes through a rolling mill. The straightening system also includes a straightening device configured
(Continued)

to straighten the material passed through the cooling device. The straightening system further includes a flatness measuring system configured to measure flatness of the material passed through the cooling device and a controller configured to receive data of the flatness of the material from the flatness measuring system and to control the cooling device in response to the data to enhance the flatness of the material.

13 Claims, 23 Drawing Sheets

(51) Int. Cl.

| | |
|---|---|
| ***B21B 37/58*** | (2006.01) |
| ***B21B 37/74*** | (2006.01) |
| ***B21B 45/02*** | (2006.01) |
| *B21D 1/02* | (2006.01) |
| *B21B 37/76* | (2006.01) |
| *B21B 38/02* | (2006.01) |

(52) U.S. Cl.
CPC ..... *B21B 45/02* (2013.01); *B21B 37/76* (2013.01); *B21B 38/02* (2013.01); *B21D 1/02* (2013.01)

(56) References Cited

U.S. PATENT DOCUMENTS

| | | | | |
|---|---|---|---|---|
| 7,617,709 | B2 * | 11/2009 | Sano | B21B 37/74 72/14.8 |
| 2009/0282884 | A1 | 11/2009 | Pawelski et al. | |
| 2010/0064748 | A1 | 3/2010 | Ootsuka et al. | |
| 2011/0208345 | A1 | 8/2011 | Soderlund | |
| 2012/0318478 | A1 | 12/2012 | Weinzierl | |
| 2013/0111965 | A1 | 5/2013 | Lee | |

FOREIGN PATENT DOCUMENTS

| | | | |
|---|---|---|---|
| CN | 102770221 | A | 11/2012 |
| CN | 103338873 | A | 10/2013 |
| DE | 102011012062 | A1 | 9/2011 |
| EP | 0153688 | A1 | 2/1985 |
| EP | 2799830 | A1 | 11/2014 |
| IT | 1072087 | B | 4/1985 |
| JP | S46-19296 | A | 5/1971 |
| JP | S63-30112 | A | 2/1988 |
| JP | H08-071628 | A | 3/1996 |
| JP | H08-090046 | A | 4/1996 |
| JP | 2002-172415 | A | 6/2002 |
| JP | 2010-537046 | A | 12/2010 |
| JP | 2013-099774 | A | 5/2013 |
| JP | 2015-503749 | A | 2/2015 |
| KR | 10-0241018 | B1 | 3/2000 |
| KR | 10-2002-0087213 | A | 11/2002 |
| KR | 20-0414939 | Y1 | 4/2006 |
| KR | 10-2009-0077972 | A | 7/2009 |
| KR | 10-2012-0053744 | A | 5/2012 |
| KR | 10-2013-0045938 | A | 5/2013 |
| KR | 10-2014-0081008 | A | 7/2014 |
| KR | 10-2014-0084662 | A | 7/2014 |
| KR | 10-2014-0084887 | A | 7/2014 |
| KR | 10-1449207 | B1 | 10/2014 |
| WO | 2009/024644 | A1 | 2/2009 |
| WO | 2012/103961 | A1 | 8/2012 |

OTHER PUBLICATIONS

Chinese Office Action dated Feb. 19, 2019 issued in Chinese Patent Application No. 201680074333.6 (with English translation).
International Search Report dated Oct. 24, 2016 issued in International Patent Application No. PCT/KR2016/008230 (with English translation).
Japanese Office Action dated Oct. 1, 2019 issued in Japanese Patent Application No. 2018-532239.

* cited by examiner

【Figure 1】
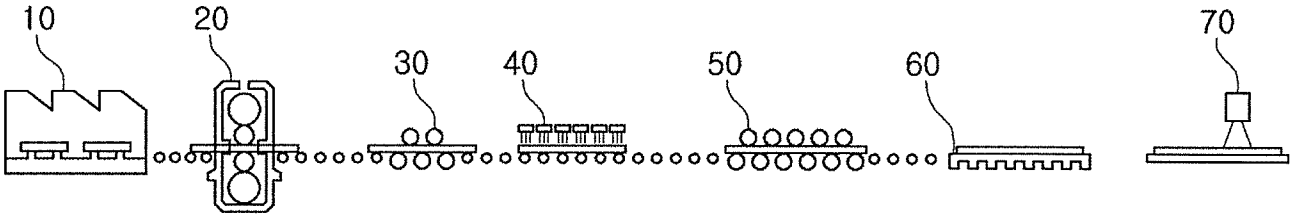

【Figure 2】
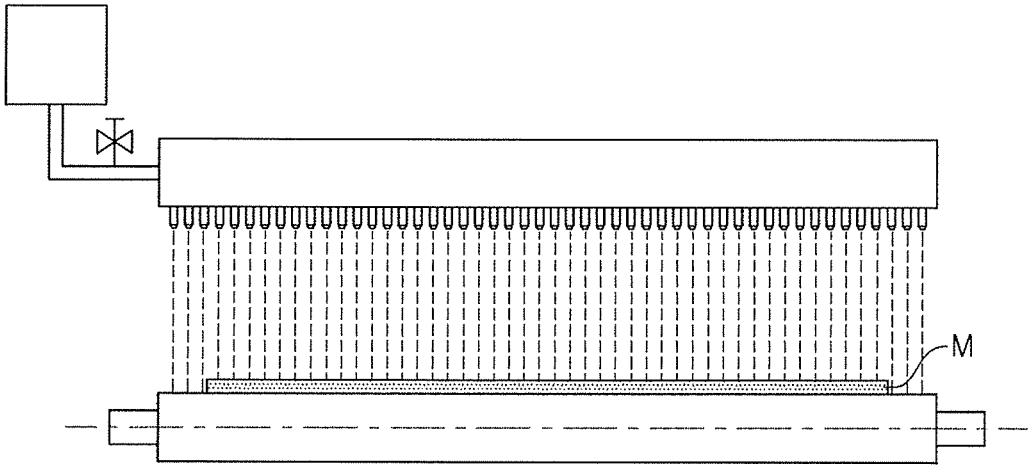

【Figure 3】
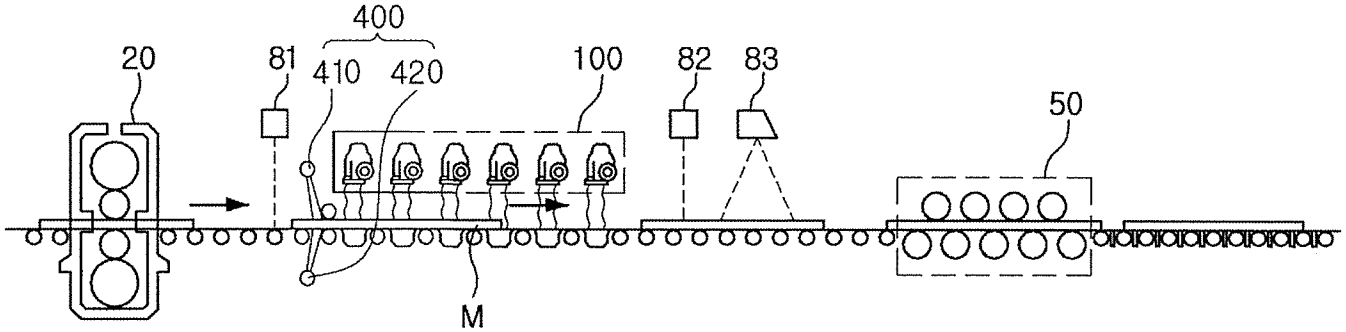

【Figure 4】
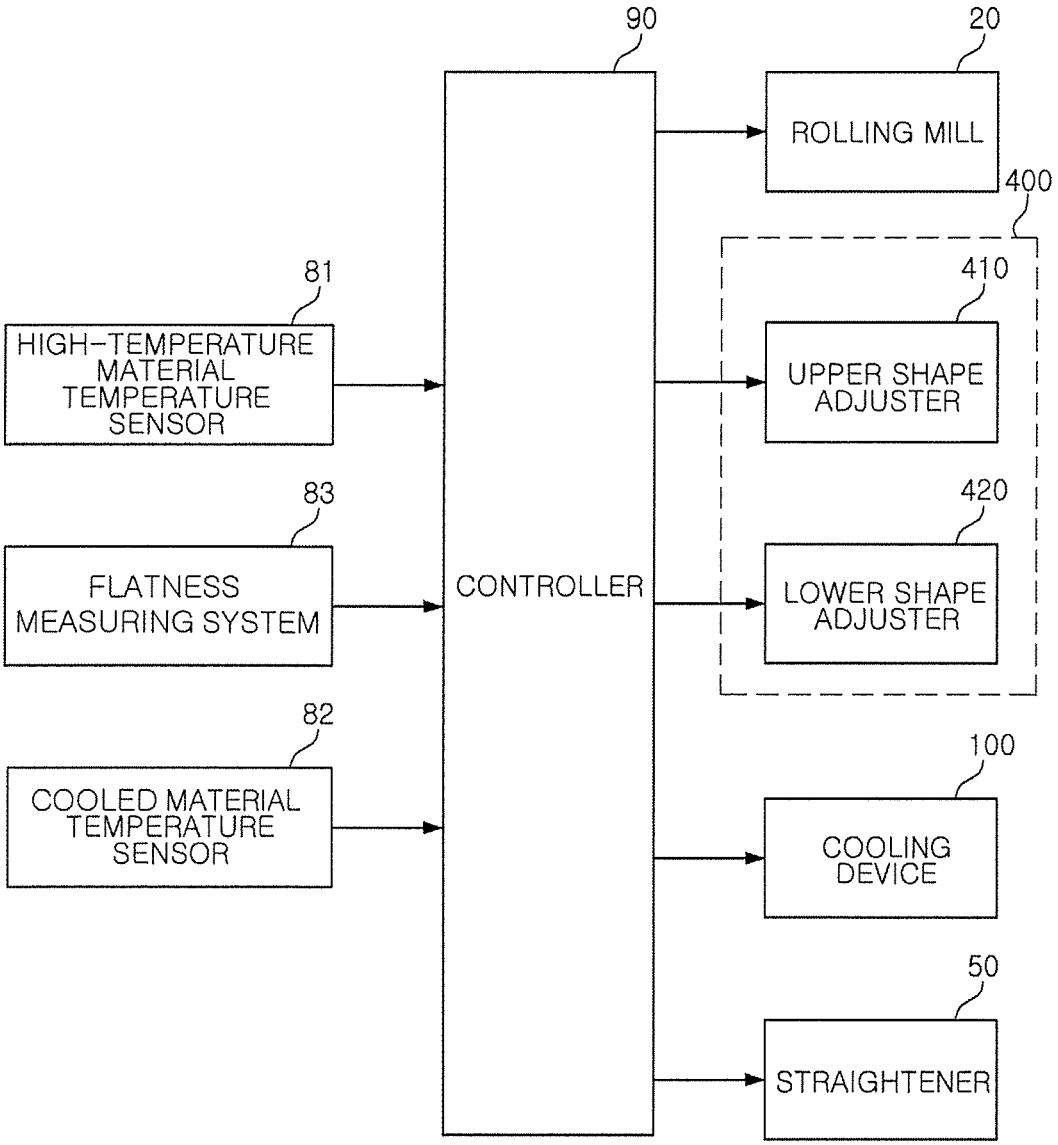

【Figure 5】
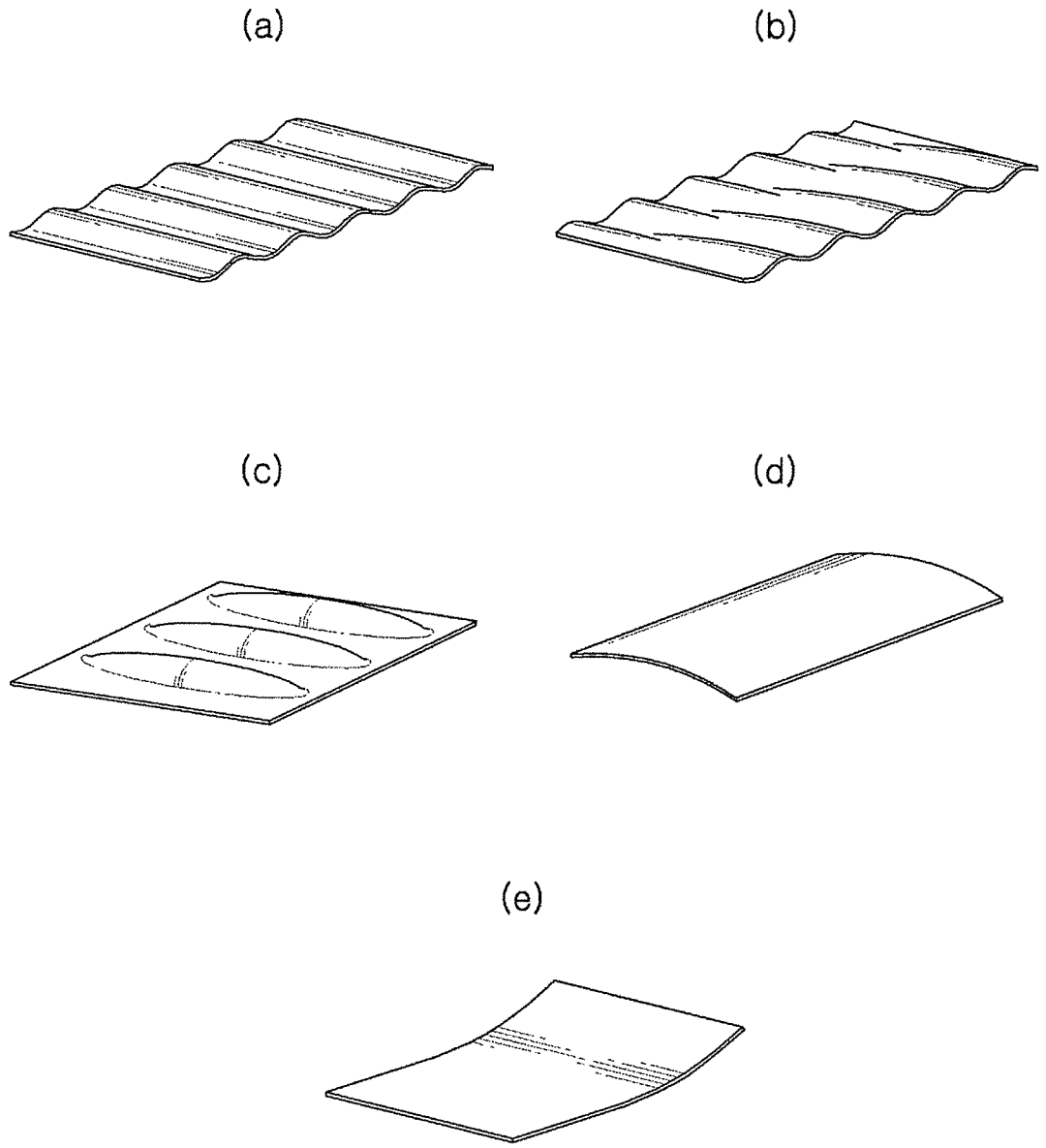

【Figure 6】
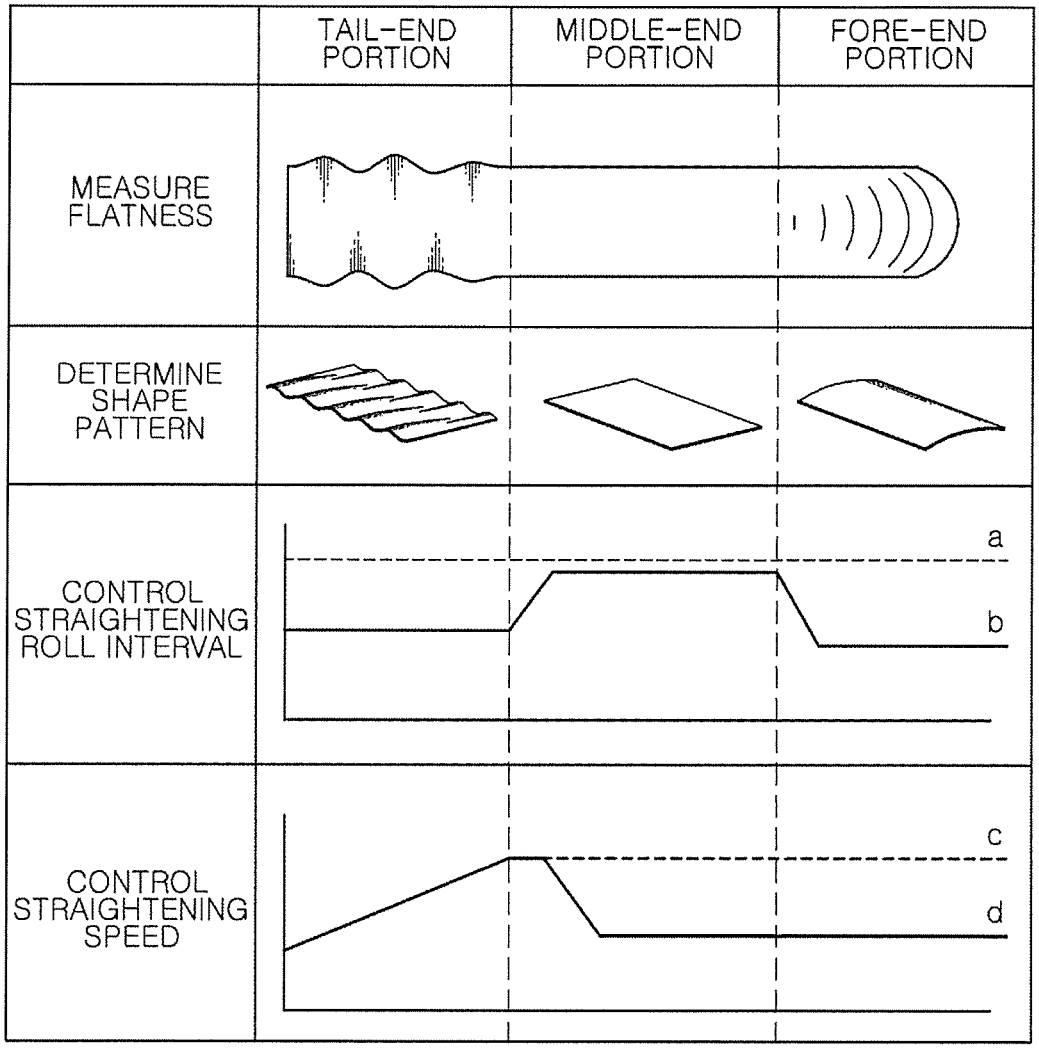

【Figure 7】
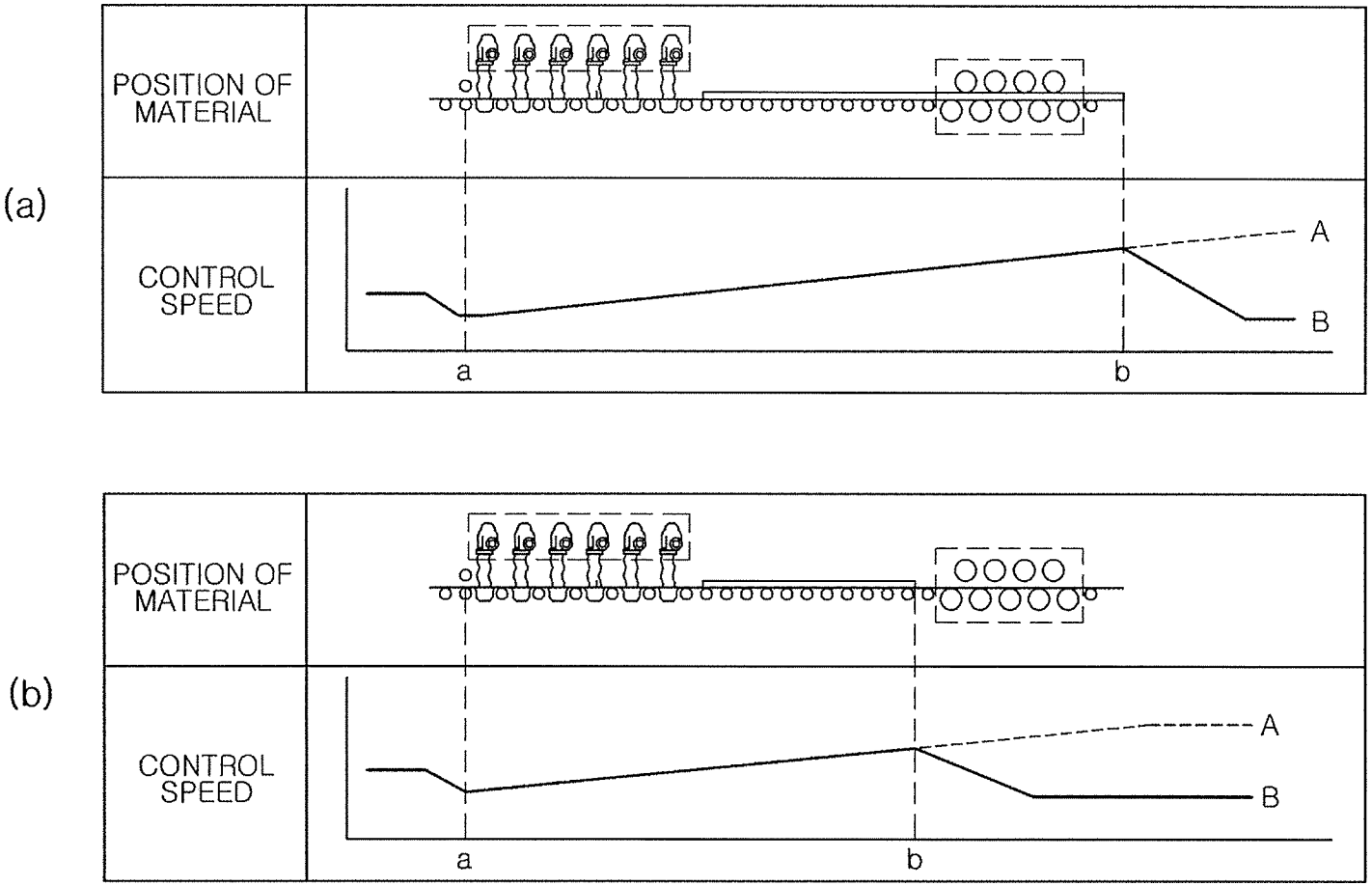

【Figure 8】
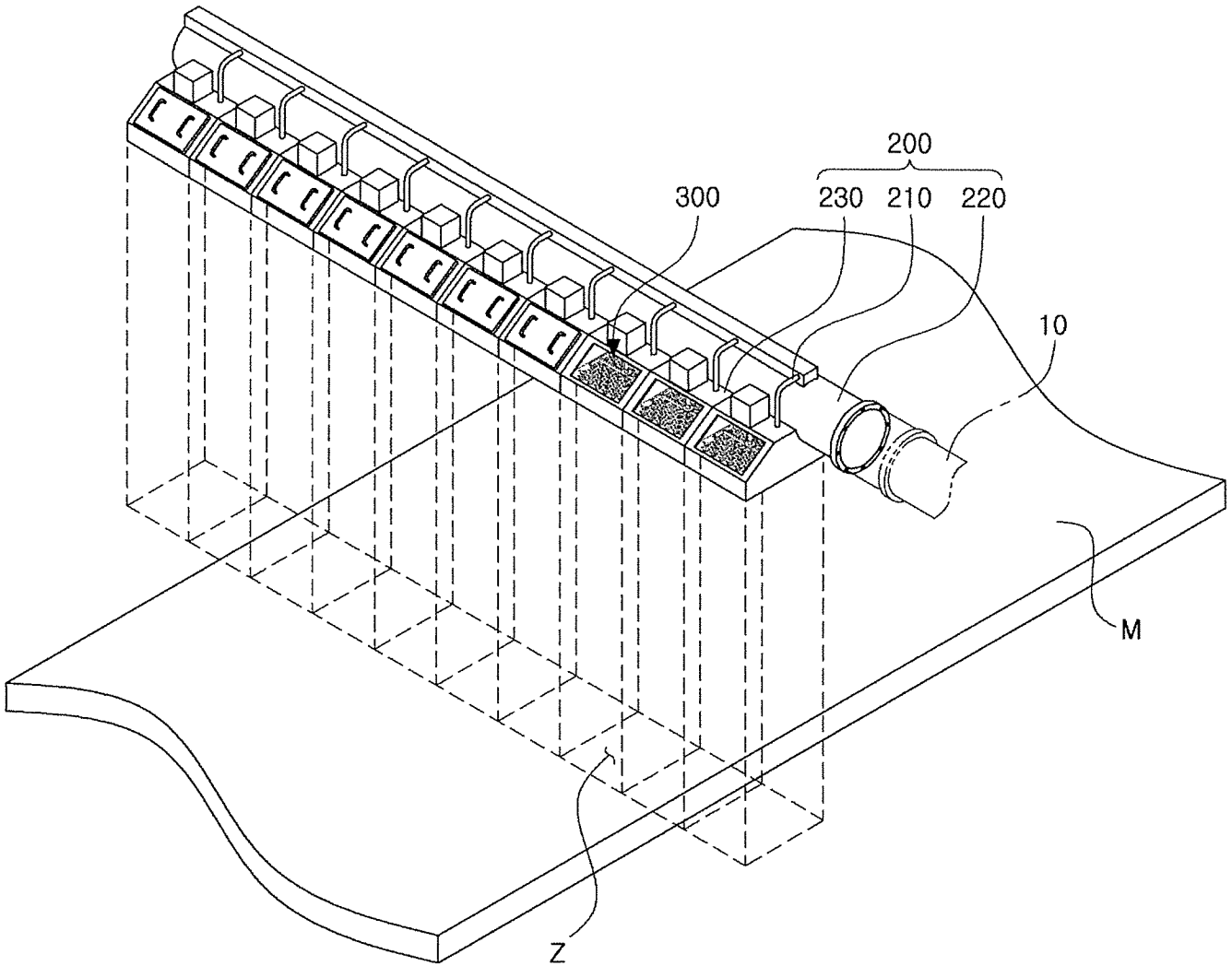

【Figure 9】
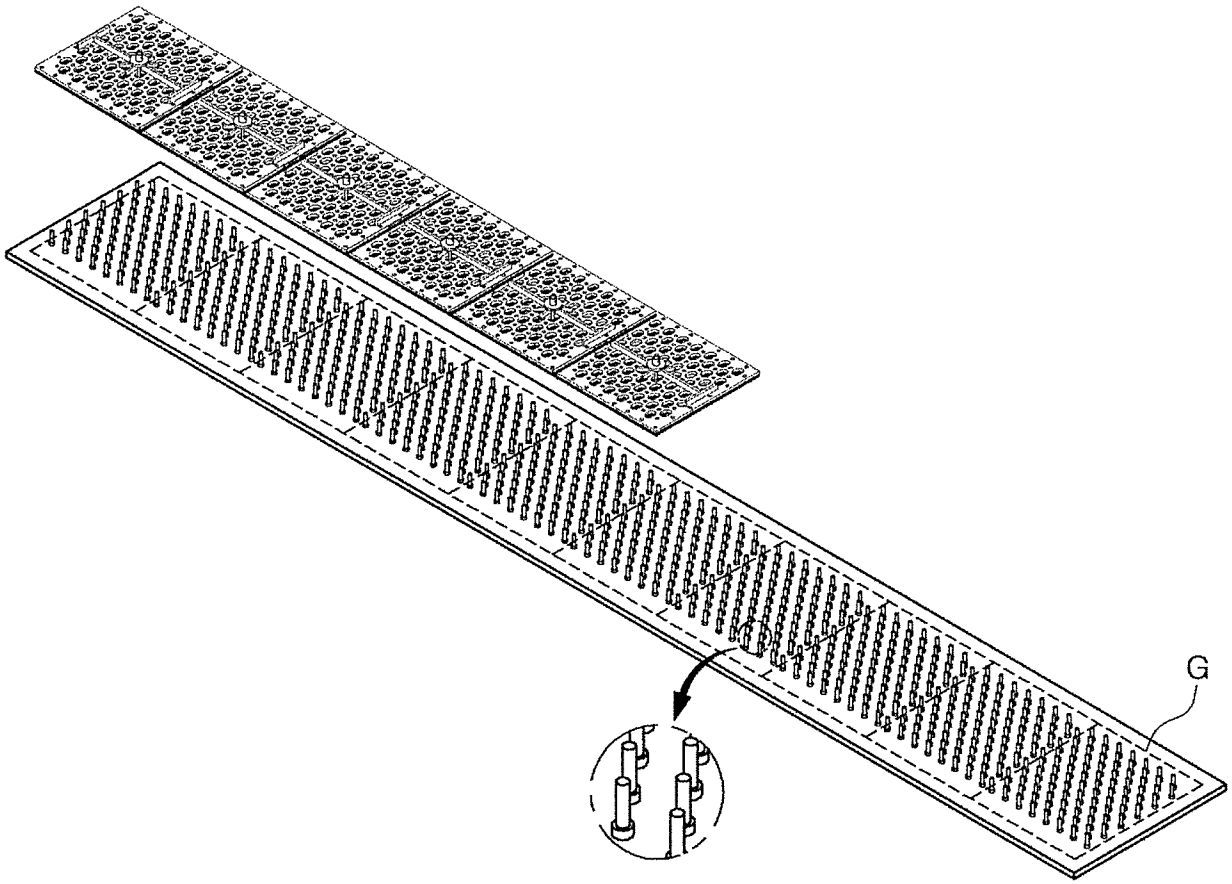

【Figure 10】
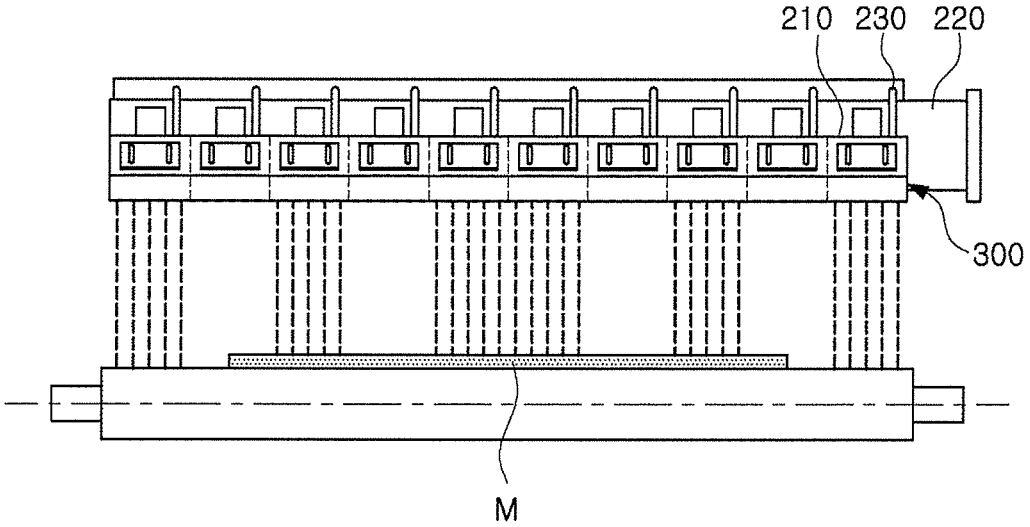

【Figure 11】
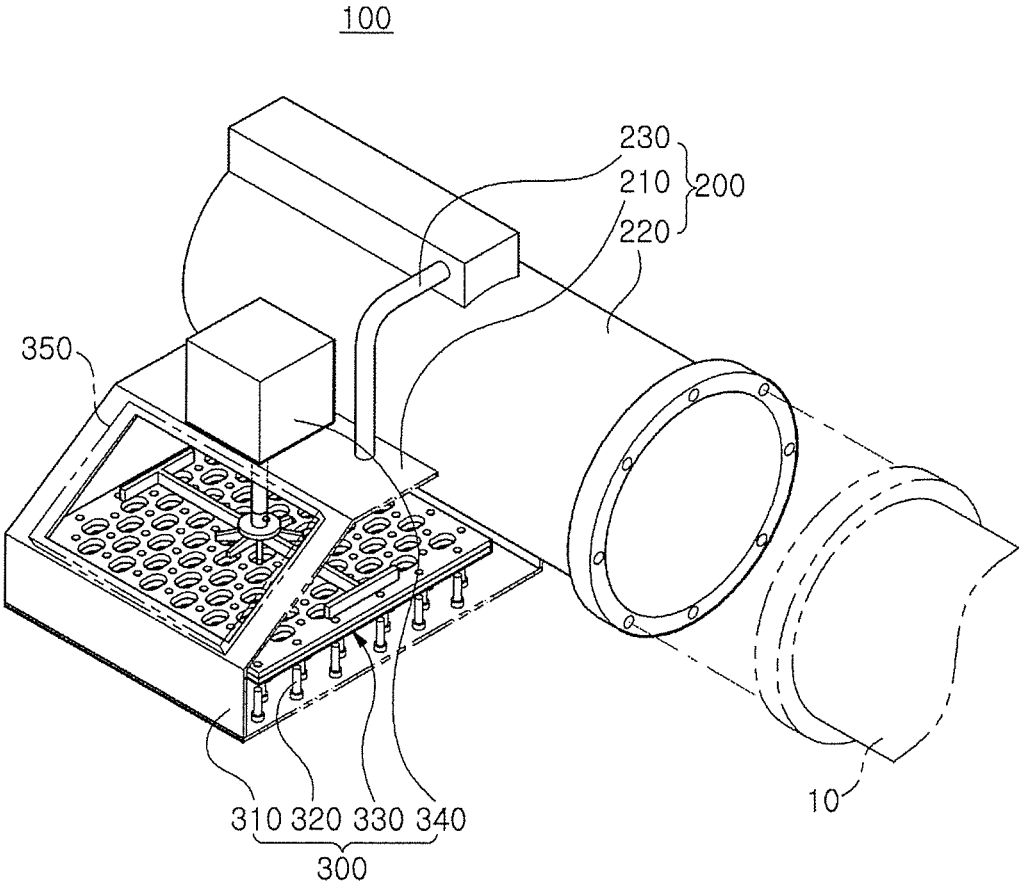

【Figure 12】
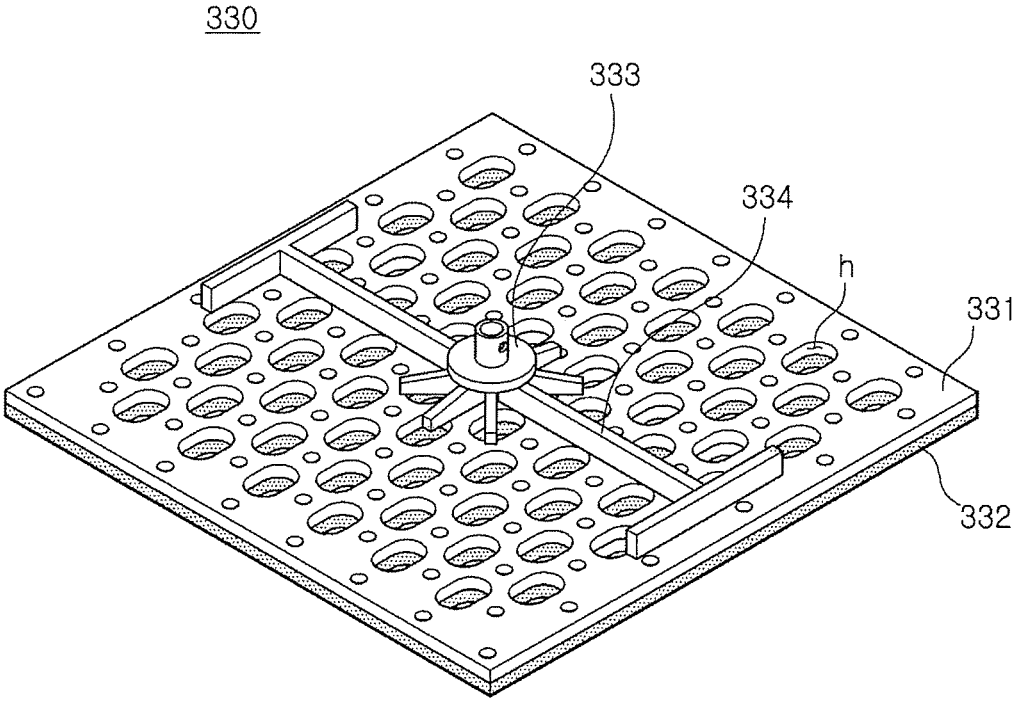

【Figure 13】
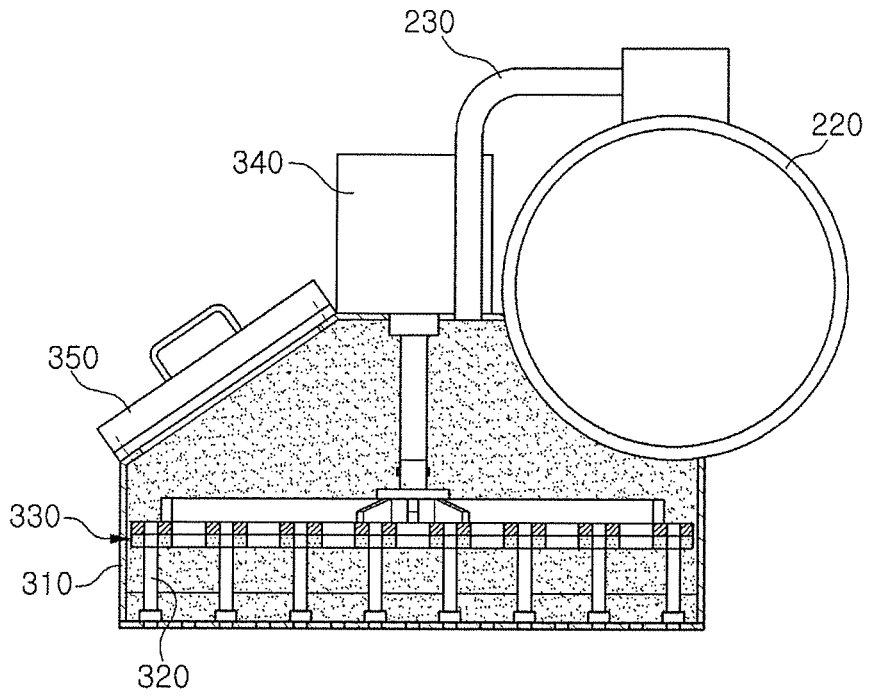

【Figure 14】
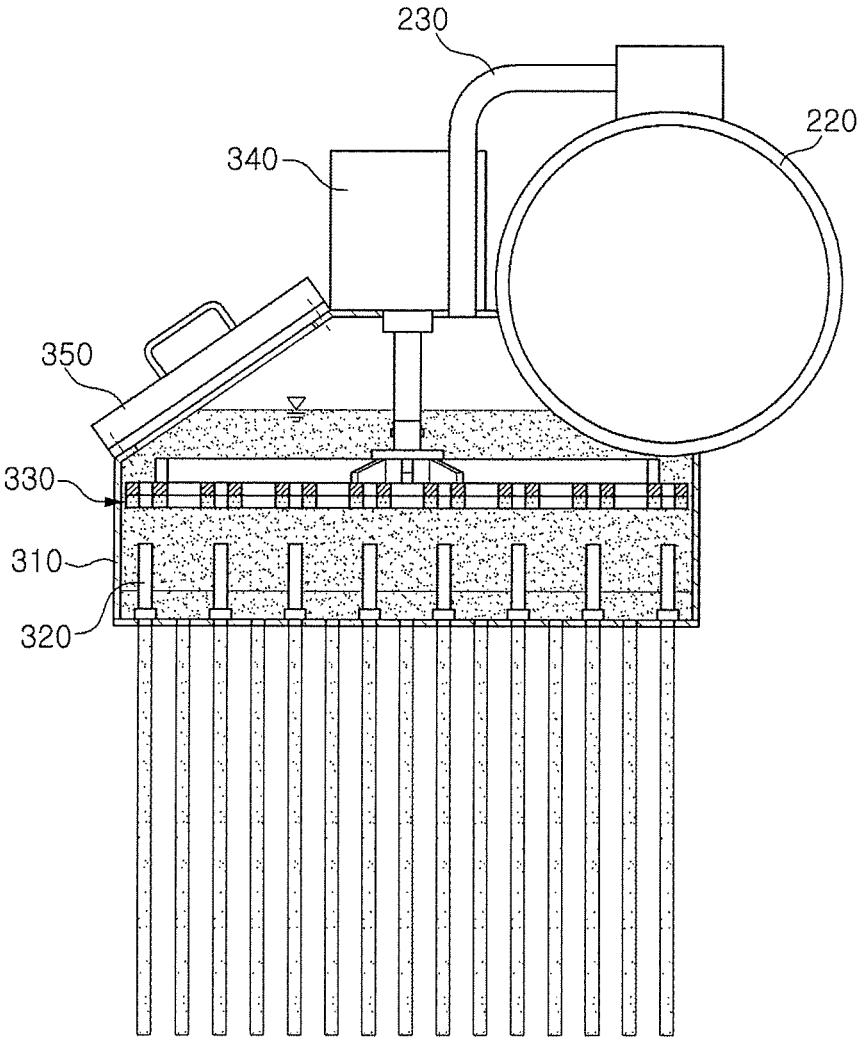

【Figure 15】
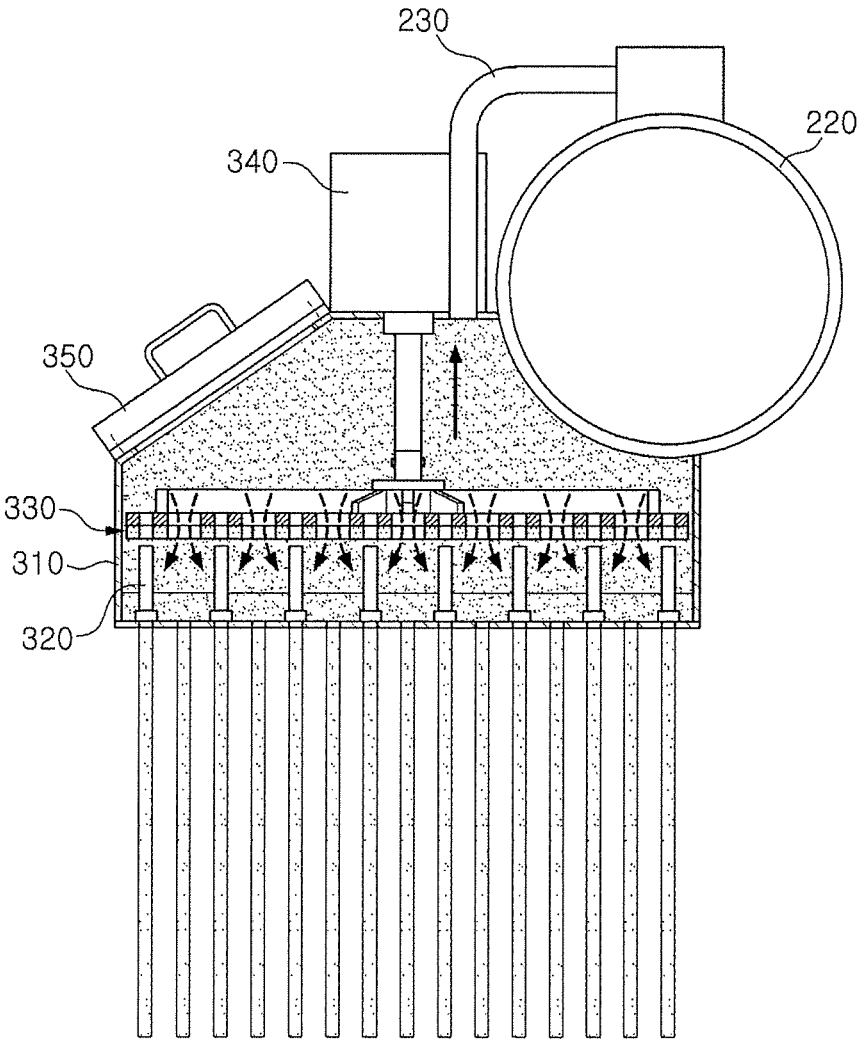

【Figure 16】
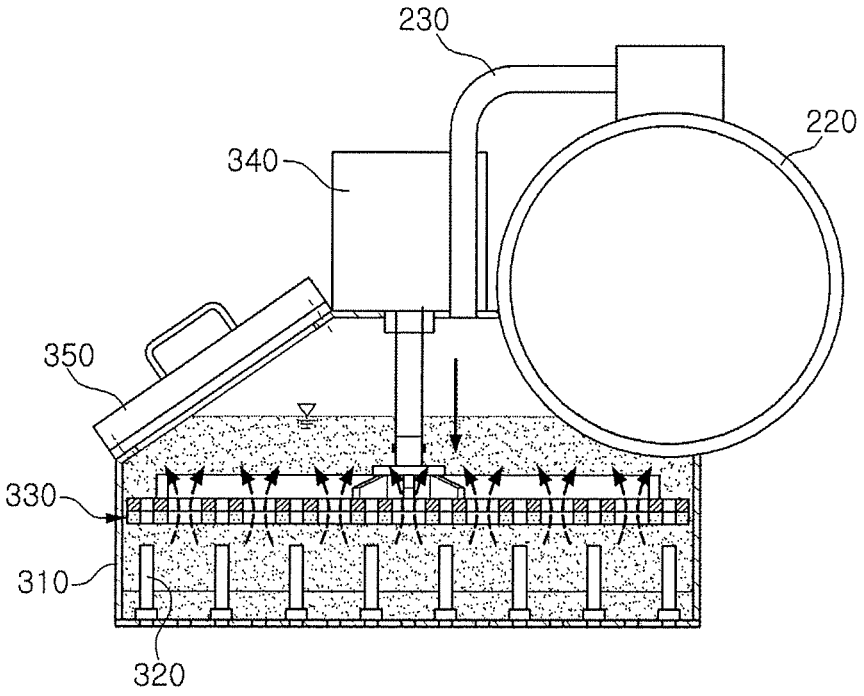

【Figure 17】
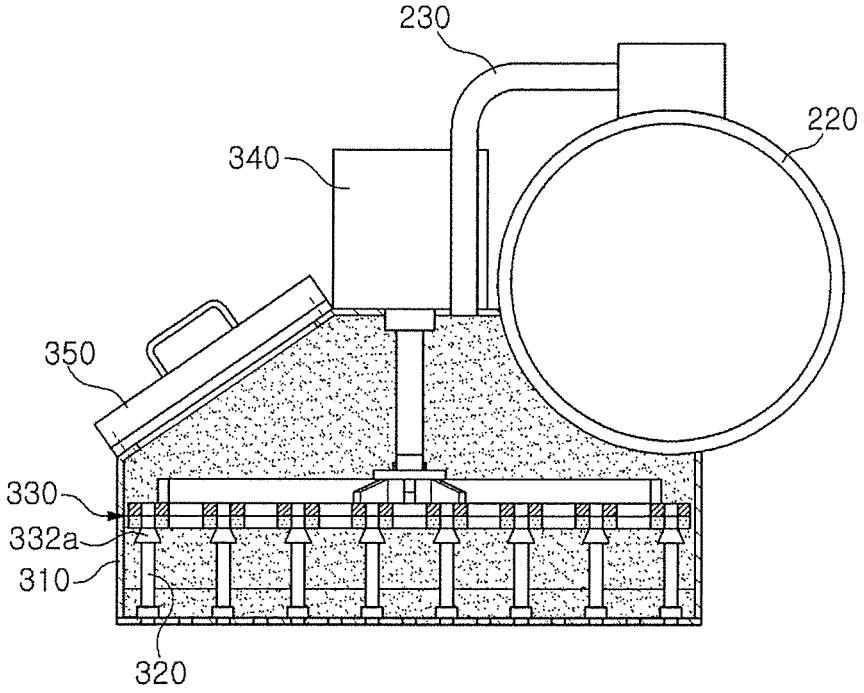

【Figure 18】
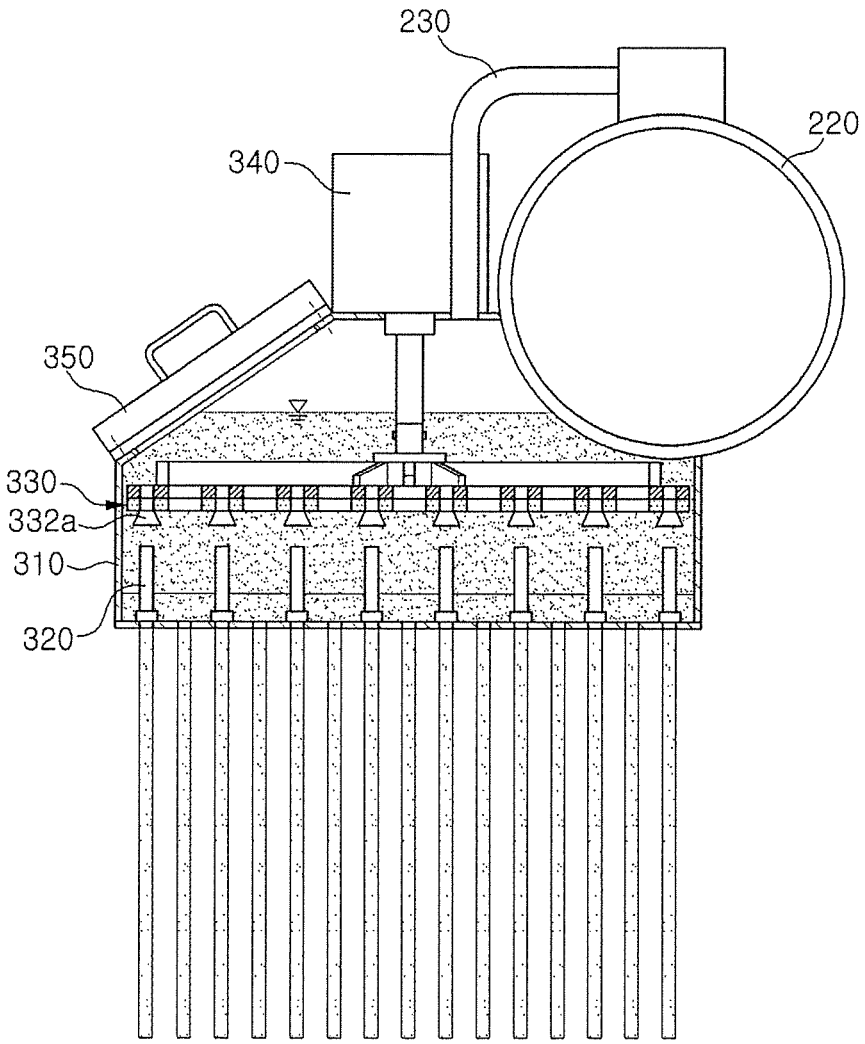

【Figure 19】
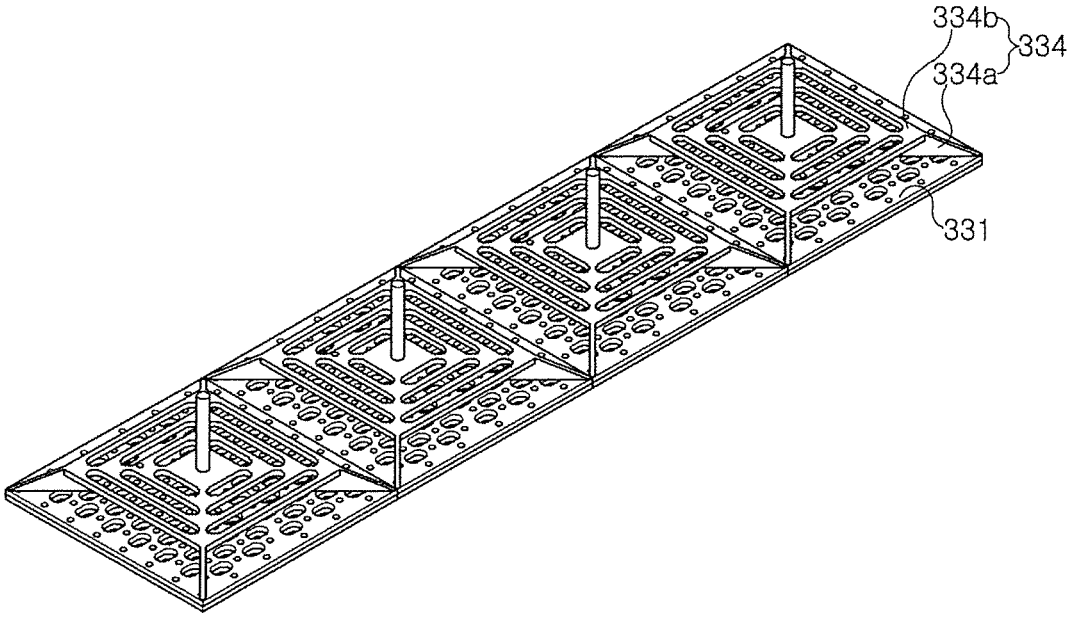
【Figure 20】
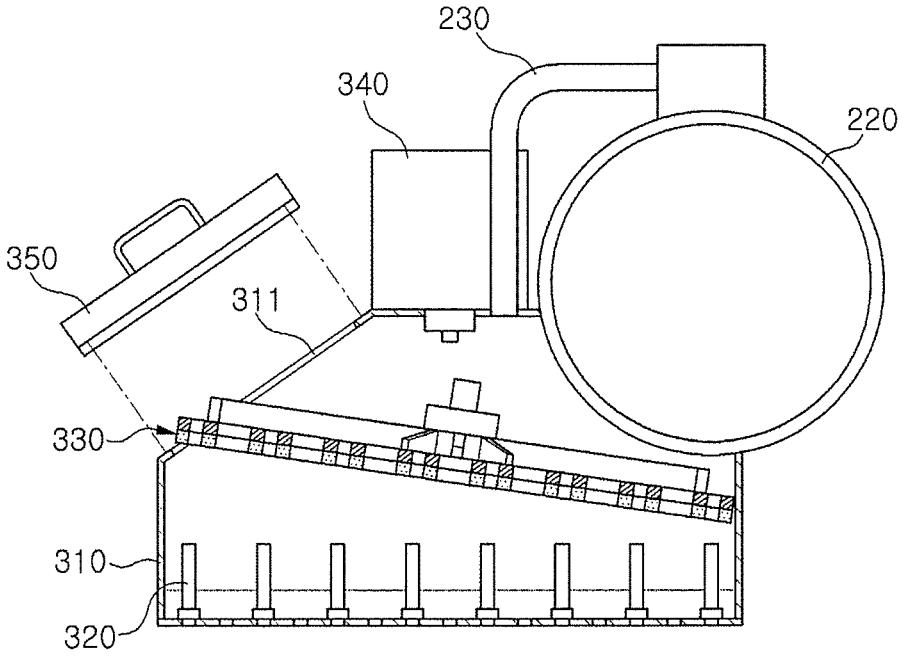

【Figure 21】
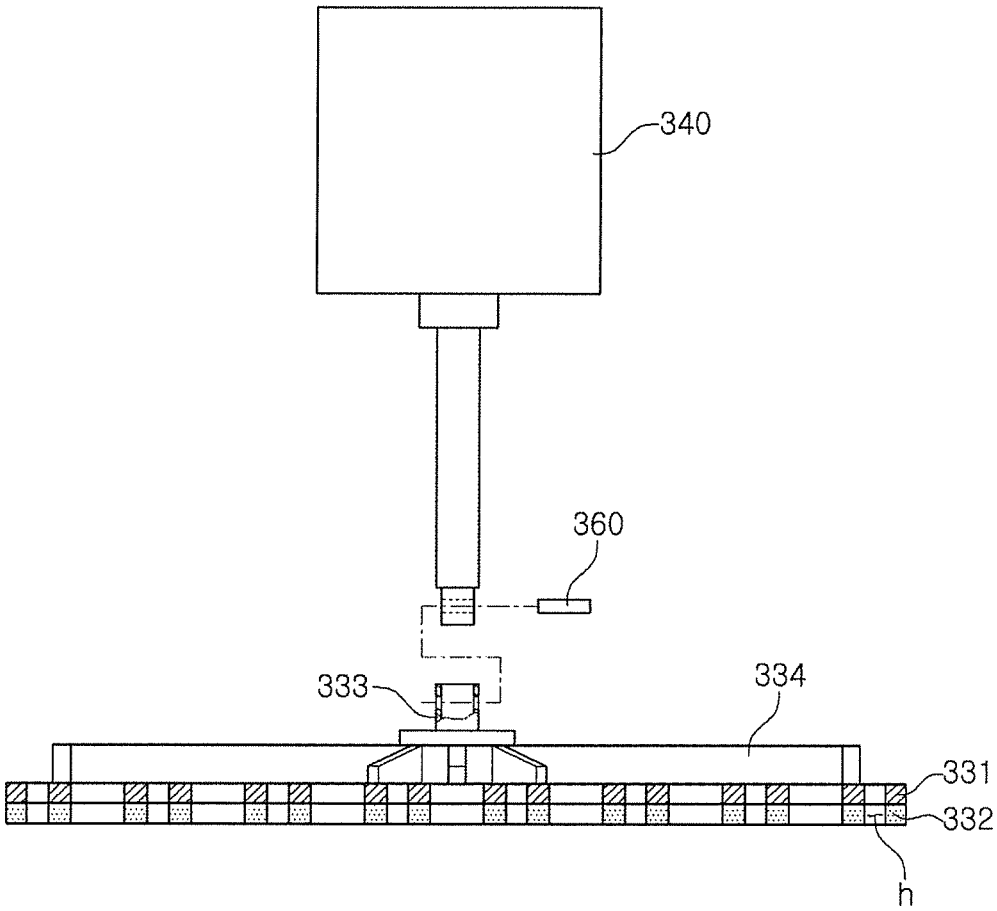

【Figure 22】
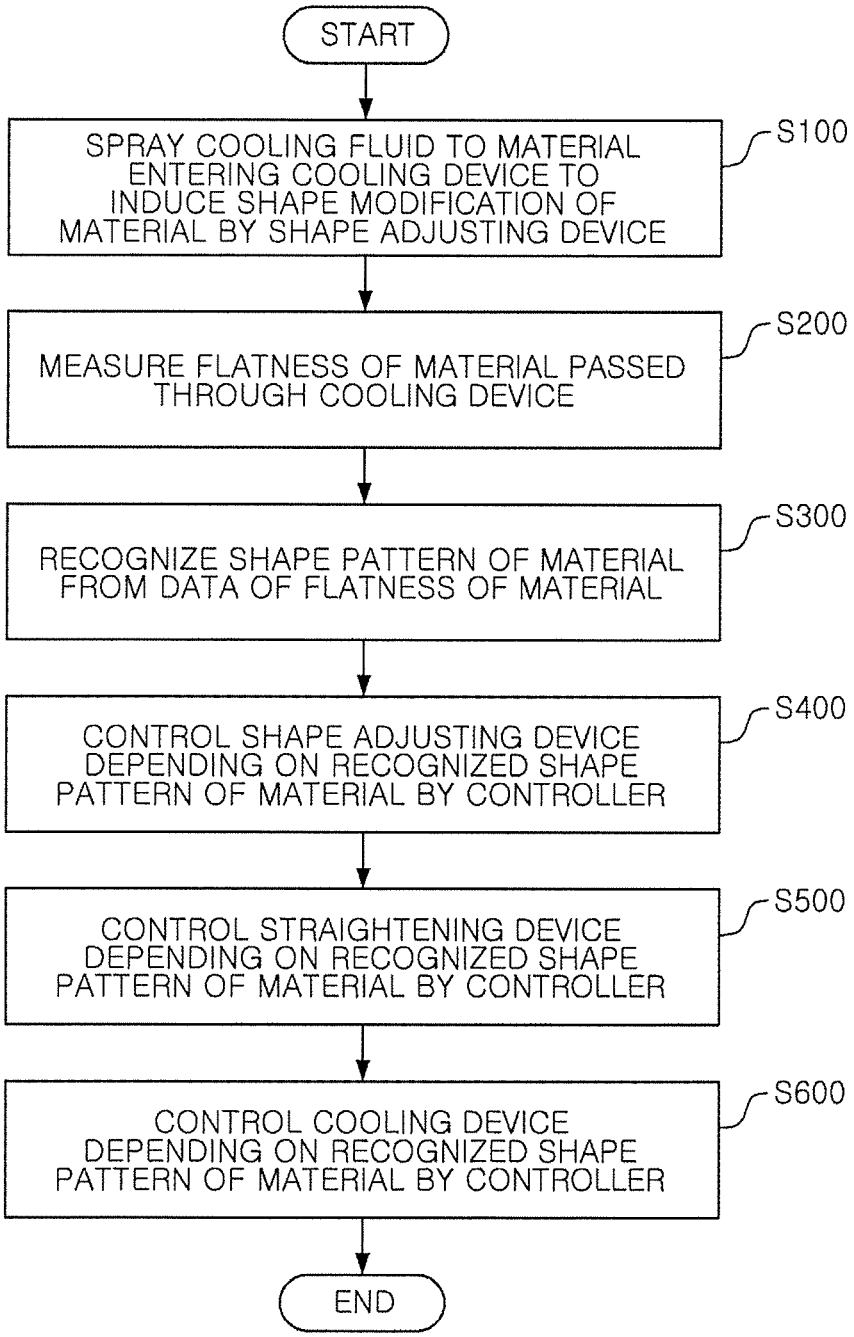

【Figure 23】
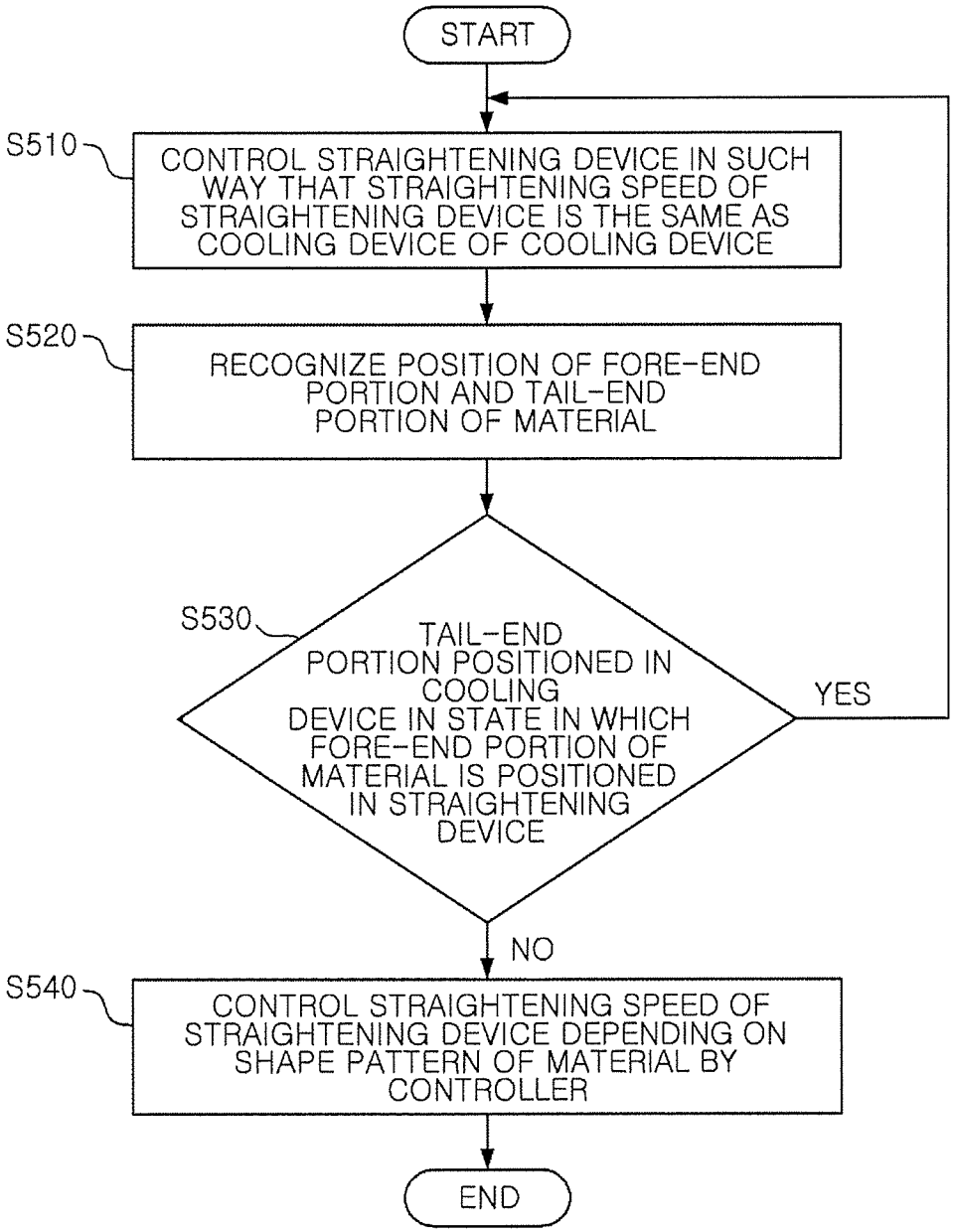

【Figure 24】
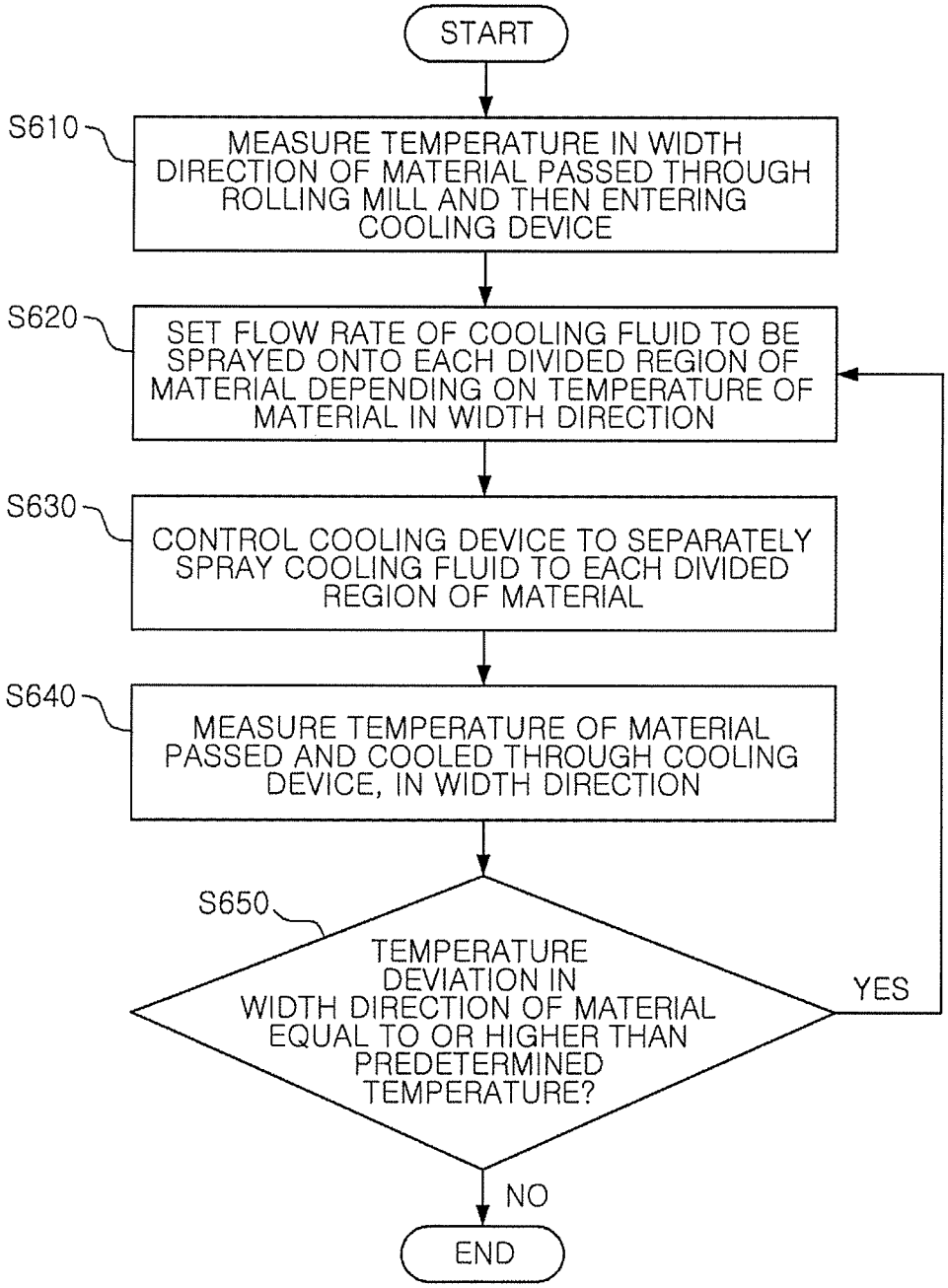

STRAIGHTENING SYSTEM AND STRAIGHTENING METHOD

CROSS REFERENCE

This patent application is the U.S. National Phase under 35 U.S.C. § 371 of International Application No. PCT/KR2016/008230, filed on Jul. 27, 2016, which claims the benefit of Korean Patent Application No. 10-2015-0184729, filed on Dec. 23, 2015 and Korean Patent Application No. 10-2015-0184739, filed on Dec. 23, 2015, the entire contents of each are hereby incorporated by reference.

TECHNICAL FIELD

The present disclosure relates to a straightening system and a straightening method, and more particularly, to a straightening system and a straightening method, for performing straightening, depending on a shape pattern of a material.

BACKGROUND ART

FIG. 1 is a schematic diagram illustrating a general thick plate processing line. Referring to FIG. 1, a material is discharged from a heating furnace 10 in a high-temperature state, is passed through a rolling mill 20, is preliminarily straightened by a reserve straightener 30 and, then, is acceleratedly cooled by a cooling device 40. The accelerated cooled material is passed through a hot straightener 50, a shape of the material is straightened and, then, the material is cooled by a cooling bed 60. In addition, the material is air-cooled by the cooling bed 60 and, then, flatness of the material is measured by inspection equipment 70 to determine whether an additional straightening process such as cold straightening is required in a subsequent process.

The straightener 50 performs a process of enhancing a shape in online and, in this case, an operation condition is determined before material rolling is terminated, depending on a steel grade, a thickness and width of a material, and a predicted temperature. However, a parameter such as a temperature change in a material before a straightening process is performed after rolling is performed, a material shape after rolling, and a material shape after accelerated cooling is not considered and, thus, there is a problem in that an accurate straightening operation may not be performed.

In a processing line for producing a material with a length of up to 55 m, as a material length is increased, a material shape is not constant and is different at a fore-end portion, a middle-end portion, and a tail-end portion thereof. Due to such a condition of a material prior to straightening, when a straightening process is performed once in the same straightening condition in a longitudinal direction, there is a limit in ensuring excellent flatness.

Furthermore, to ensure excellent flatness, there is a need to significantly reduce a temperature deviation of a material in a width direction to prevent the material from being deformed in a cooling process prior to a straightening process.

FIG. 2 is a schematic diagram illustrating a conventional cooling device applied to a thick plate processing line.

Referring to FIG. 2, the conventional cooling device is configured to spray a predetermined amount of cooling fluid in a width direction of a material. However, when a predetermined amount of cooling fluid is sprayed in the width direction of the material, a central portion of the material has a small contact area with a cooling fluid, based on a material volume to have a degraded cooling effect and an edge portion of the material has a large contact area with a cooling fluid to have an enhanced cooling effect and, thus, there is a problem in a temperature deviation of an overall material.

DISCLOSURE

Technical Problem

An aspect of the present disclosure is to provide a straightening system and a straightening method, for controlling a straightening device and a cooling device depending on a shape pattern of a material, to enhance flatness.

An aspect of the present disclosure is to provide a straightening system and a straightening method, for controlling a cooling device varying a flow rate of a cooling fluid supplied in a width direction to supply the cooling fluid depending on a material width, to significantly reduce a temperature deviation of a high-temperature material in a width direction thereof.

Technical Solution

According to an aspect of the present disclosure, a straightening system includes a cooling device configured to spray a cooling fluid in a predetermined pattern with respect to a plurality of regions of a material, divided in a width direction, to cool the material that is heated in a heating furnace and then passes through a rolling mill; a straightening device configured to straighten the material passed through the cooling device; a flatness measuring system configured to measure flatness of the material passed through the cooling device; and a controller configured to receive data of the flatness of the material from the flatness measuring system and to control the cooling device in response to the data to enhance the flatness of the material.

The controller may store a plurality of pieces of shape pattern data and data for controlling the cooling device based on the shape pattern and match a measured shape pattern of the material and the stored shape pattern to control the cooling device.

The controller may control the cooling device to adjust a flow rate of a cooling fluid sprayed in the width direction of the material, depending on a shape pattern of the material.

The straightening system may further include a high-temperature material temperature sensor disposed in an upstream region of the cooling device and configured to measure a temperature of the material entering the cooling device, with respect to a width direction of the material, wherein the controller may control the cooling device to adjust a flow rate of a cooling fluid sprayed in the width direction of the material depending on width direction temperature data of the material, received from the high-temperature material temperature sensor.

The straightening system may further include a cooled material temperature sensor disposed in a downstream region of the cooling device and configured to measure a temperature of the material passed through the cooling device, with respect to the width direction of the material, wherein the controller may reset a flow rate of a cooling fluid to be sprayed onto each divided region of the material to control the cooling device when a temperature deviation of the material in the width direction, received from the cooled material temperature sensor, is equal to or higher than predetermined temperature.

The cooling device may include a base frame connected to an external cooling fluid supplying line and a nozzle assembly disposed on the base frame and configured to spray a cooling fluid in a predetermined pattern with respect to a plurality of divided regions, in the width direction of the material.

The nozzle assembly may be disposed on the base frame to receive a cooling fluid and may be configured with nozzles arranged in a plurality of rows and columns, a predetermined number of nozzles may form a group and may be divided into a plurality of group nozzles, and the group nozzles may be closed and open to spray a cooling fluid to a predetermined region.

The base frame may be disposed on a moved material and the plurality of group nozzles of the nozzle assembly may be arranged in a line in parallel to the width direction of the material.

The nozzle assembly may control the plurality of group nozzles to be separately opened and closed, and spray cooling fluid at different flow rates in the width direction of the material for the respective group nozzles.

The nozzle assembly may include a housing configured to store a cooling fluid, the nozzle provided in plural protrude into the housing and including a through hole formed in a longitudinal direction to spray the cooling fluid externally, a mask provided in a plural number and disposed on each of the plurality of group nozzles to close and open each of the group nozzles, and an actuator disposed in a plural number in the housing and configured to separately move the plurality of masks in upward and downward directions.

The mask may include a base plate including a plurality of flow holes formed to allow a cooling fluid to flow and having one surface coupled to the actuator, and an elastic member disposed on the other surface of the base plate, including holes formed in a position corresponding to the flow holes of the base plate, and configured to seal the through hole of the nozzle when the nozzle is closed.

The base plate of the mask may include a coupler formed to protrude from a center of one surface and coupled to the actuator, and a reinforcing rib formed to extend to a circumference of the base plate from the coupler to prevent the base plate from being deformed.

The nozzle assembly may be provided to discharge a predetermined amount of a cooling fluid through group nozzles positioned at opposite lateral ends among the plurality of group nozzles to prevent water hammering in a region in which the cooling fluid is stored and supplied.

The controller may store a plurality of pieces of shape pattern data and data for controlling the straightening device based on the shape pattern and match a measured shape pattern of the material and the stored shape pattern to control the straightening device.

The controller may control at least one of a straightening roll interval and straightening speed of the straightening device depending on the shape pattern of the material.

The straightening system may further include a position detection sensor configured to recognize positions of a fore-end portion and a tail-end portion of the material.

The controller may receive data from the position detection sensor and, when it is detected that the fore-end portion of the material is positioned in the straightening device and the tail-end portion of the material is positioned in the cooling device, the controller may control the straightening device in such a way that straightening speed of the straightening device is the same as the cooling speed of the cooling device.

The controller may receive data from the position detection sensor and, when it is detected that the fore-end portion of the material is positioned in the straightening device and the tail-end portion of the material is separated from the cooling device, the controller may control the straightening speed of the straightening device depending on a shape pattern of the material.

The controller may receive data from the flatness measuring system at a predetermined time interval and control at least one of a straightening roll interval and straightening speed of the straightening device depending on a shape pattern of the material based on the data.

The straightening system may further include a shape adjusting device disposed in an upstream region of the cooling device and configured to spray a cooling fluid to the material to induce shape modification of the material.

The controller may store a plurality of pieces of shape pattern data and data for controlling the shape adjusting device based on the shape pattern and match a measured shape pattern of the material and the stored shape pattern to control the shape adjusting device.

The shape adjusting device may spray a cooling fluid in the width direction of the material and adjust a flow rate of a sprayed cooling fluid to induce shape modification of the material.

The shape adjusting device may include an upper shape adjuster disposed in an upper portion of the material and configured to spray a cooling fluid to an upper surface of the material, and a lower shape adjuster disposed in a lower portion of the material and configured to spray a cooling fluid to a lower surface of the material.

The controller may operate at least one of the upper shape adjuster and the lower shape adjuster depending on the shape pattern of the material and perform control to spray a cooling fluid to at least one of the upper and lower surfaces of the material.

The controller may set a flow rate of a cooling fluid to be sprayed onto the upper and lower surfaces of the material depending on the shape pattern of the material and control a flow rate of a sprayed cooling fluid of the upper and lower shape adjusters.

The shape adjusting device may spray a cooling fluid in the width direction of the material at a predetermined pressure to prevent a cooling fluid sprayed onto the material by the cooling device from flowing toward the heating furnace.

The shape pattern of the material may be set to a total wave pattern with an overall wave height, an edge wave pattern with a maximum wave height at an edge portion, a center wave pattern with a maximum wave height at a central portion in a longitudinal direction, a curved pattern rounded in a width direction, and a curl pattern with a wound fore-end portion or tail-end portion.

The controller may control at least one of rolling force and rolling speed of the rolling mill depending on the shape pattern of the material.

According to another aspect of the present disclosure, a straightening method includes measuring flatness of a material passed through a rolling mill and cooled by a cooling device, recognizing a shape pattern of the material from data of the flatness of the material, controlling a straightening device depending on the shape pattern of the material by a controller, and controlling a cooling device for spraying a cooling fluid in a predetermined pattern with respect to a plurality of divided regions in the width direction of the material depending on the shape pattern of the material by the controller.

The controlling of the straightening device may include controlling at least one of a straightening roll interval and straightening speed of the straightening device depending on the shape pattern of the material.

The controlling of the straightening device may include detecting a position of a fore-end portion and a tail-end portion of the material.

The controlling of the straightening device may include, when it is detected that the fore-end portion of the material is positioned in the straightening device and the tail-end portion of the material is positioned in the cooling device, controlling the straightening device by the controller in such a way that the straightening speed of the straightening device is the same as the cooling speed of the cooling device.

The controlling of the straightening device may include, when it is detected that the fore-end portion of the material is positioned in the straightening device and the tail-end portion of the material is separated from the cooling device, controlling the straightening speed of the straightening device depending on the shape pattern of the material by the controller.

The controlling of the straightening device may include receiving data of flatness at a predetermined time interval and controlling at least one of a straightening roll interval and straightening speed of the straightening device depending on a shape pattern of the material based on the data.

The controlling of the cooling device may include dividing the material into predetermined regions, in the width direction of the material and setting a flow rate of a cooling fluid to be sprayed onto each divided region of the material depending on the shape pattern of the material, and controlling a cooling device formed by arranging a plurality of group nozzles in a line in the width direction of the material to separately spray a cooling fluid to each divided region of the material.

The controlling of the cooling device may further include measuring temperature of a high-temperature material passed through a rolling mill and which then enters the cooling device in the width direction of the material, wherein a flow rate of a cooling fluid to be sprayed onto each divided region of the material may be set in response to temperature data with respect to the width direction of the material.

The setting of the flow rate of the cooling fluid may include setting the flow rate to discharge a predetermined amount of a cooling fluid through group nozzles positioned at opposite lateral ends among the plurality of group nozzles to prevent water hammering in a region in which the cooling fluid is stored and supplied.

The cooling device may separately close and open the plurality of group nozzles to selectively spray a cooling fluid to a specific region with respect to the width direction of the material.

The cooling device may control the plurality of group nozzles to be separately closed and open to spray cooling fluid at different flow rates in the width direction of the material for the respective group nozzles.

The straightening method may further include measuring temperature of a cooled material that is passed and cooled through the cooling device in the width direction of the material, wherein a flow rate of a cooling fluid to be sprayed onto each divided region may be reset when a temperature deviation of the material in the width direction, measured in the measuring of the temperature of the cooled material, is equal to or higher than predetermined temperature.

The straightening method may further include adjusting a shape for spraying a cooling fluid to a material passed through a rolling mill and enters the cooling device to induce shape deformation by a shape adjusting device, and controlling the shape adjusting device depending on the recognized shape pattern of the material by the controller.

The shape adjusting device may include an upper shape adjuster disposed on the material and configured to spray a cooling fluid to an upper surface of the material and a lower shape adjuster disposed below the material and configured to spray a cooling device to a lower surface of the material.

The controlling of the shape adjusting device may include operating at least one of the upper shape adjuster and the lower shape adjuster to spray a cooling fluid to at least one of upper and lower surface of the material depending on the shape pattern of the material by the controller.

The controlling of the shape adjusting device may include setting a flow rate of a cooling fluid to be sprayed onto upper and lower surfaces of the material, depending on the shape pattern of the material and controlling a flow rate of a sprayed cooling fluid of the upper shape adjuster and the lower adjuster.

The straightening method may further include controlling at least one of rolling force and rolling speed of the rolling mill depending on the shape pattern of the material.

Advantageous Effects

As set forth above, in a straightening system and a straightening method according to an exemplary embodiment in the present disclosure, a straightening roll interval and a straightening speed may be set depending on a shape pattern of a material, and a cooling flow rate with respect to a width direction of a cooling device may be controlled to enhance flatness of the material.

According to an exemplary embodiment, the cooling device may be controlled to vary a flow rate of a cooling fluid supplied in a width direction of a material, thereby significantly reducing a temperature deviation with respect to a width direction of a high-temperature material.

DESCRIPTION OF DRAWINGS

FIG. 1 is a schematic diagram illustrating a general thick plate processing line.

FIG. 2 is a schematic diagram illustrating a conventional cooling device applied to a thickness plate processing line.

FIG. 3 is a schematic diagram illustrating a straightening system according to an exemplary embodiment of the present disclosure.

FIG. 4 is a schematic block diagram illustrating a straightening system according to an exemplary embodiment of the present disclosure.

FIG. 5 is a schematic diagram illustrating a material shape pattern stored in a controller of a straightening system according to an exemplary embodiment of the present disclosure.

FIG. 6 is a schematic graph illustrating control of a straightening roll interval and control of straightening speed of a straightening device in a longitudinal direction of a material in a straightening system according to an exemplary embodiment of the present disclosure.

FIG. 7 is a schematic graph illustrating control of straightening speed of a straightening device depending on a material length in a straightening system according to an exemplary embodiment of the present disclosure.

FIG. 8 is a perspective view of a cooling device of a straightening system according to an exemplary embodiment of the present disclosure.

FIG. 9 is a schematic perspective view of a plurality of group nozzles in a cooling device of a straightening system according to an exemplary embodiment of the present disclosure.

FIG. 10 is a schematic front view of an operating state of a cooling device in a straightening system according to an exemplary embodiment of the present disclosure.

FIG. 11 is a schematic perspective view obtained by enlarging a portion of a cooling device of a straightening system according to an exemplary embodiment of the present disclosure.

FIG. 12 is a schematic perspective view obtained by taking a mask of a cooling device in a straightening system according to an exemplary embodiment of the present disclosure.

FIG. 13 is a schematic cross-sectional view showing a state in which a nozzle is closed in a cooling device of a straightening system according to an exemplary embodiment of the present disclosure.

FIG. 14 is a schematic cross-sectional view showing a state in which a nozzle is open in a cooling device of a straightening system according to an exemplary embodiment of the present disclosure.

FIG. 15 is a schematic diagram illustrating a state in which a cooling fluid is moved through a flow hole of a mask when a nozzle is open in a cooling device of a straightening system according to an exemplary embodiment of the present disclosure.

FIG. 16 is a schematic diagram illustrating a state in which a cooling fluid is moved through a flow hole of a mask when a nozzle is closed in a cooling device of a straightening system according to an exemplary embodiment of the present disclosure.

FIG. 17 is a schematic cross-sectional view showing a state in which a nozzle is closed using a mask according to another exemplary embodiment in a cooling device of the straightening system according to an exemplary embodiment of the present disclosure.

FIG. 18 is a schematic cross-sectional view showing a state in which a nozzle is open using a mask according to another exemplary embodiment in a cooling device of the straightening system according to an exemplary embodiment of the present disclosure, FIG. 19 is a schematic cross-sectional view obtained by taking a mask according to another exemplary embodiment in a cooling device of a straightening system according to another exemplary embodiment of the present disclosure.

FIG. 20 is a schematic diagram illustrating a state in which a mask is replaced in a cooling device of a straightening system according to an exemplary embodiment of the present disclosure.

FIG. 21 is a schematic diagram illustrating a state in which a mask is detached from and attached to a cooling device of a straightening system according to an exemplary embodiment of the present disclosure.

FIG. 22 is a schematic flowchart of a straightening method according to an exemplary embodiment of the present disclosure.

FIG. 23 is a schematic flowchart of a straightening device controlling step of a straightening method according to an exemplary embodiment of the present disclosure.

FIG. 24 is a schematic flowchart of a cooling device controlling step of a straightening method according to an exemplary embodiment of the present disclosure.

BEST MODE FOR INVENTION

For the purposes of promoting an understanding of the features of the present disclosure, a straightening system and a straightening method according to exemplary embodiments of the present disclosure are described below in more detail.

Hereinafter, the present disclosure will be described in detail by explaining exemplary embodiments of the invention with reference to the attached drawings. The same reference numerals in the drawings denote like elements, and a repeated explanation thereof will not be given. In the description of the present disclosure, certain detailed explanations of related art are omitted when it is deemed that they may unnecessarily obscure the essence of the invention.

Reference will now be made in detail to the embodiments, examples of which are illustrated in the accompanying drawings.

FIG. 3 is a schematic diagram illustrating a straightening system according to an exemplary embodiment of the present disclosure. FIG. 4 is a schematic block diagram illustrating the straightening system. FIG. 5 is a schematic diagram illustrating a material shape pattern stored in a controller of the straightening system. FIG. 6 is a schematic graph illustrating control of a straightening roll interval and control of straightening speed of a straightening device in a longitudinal direction of a material in the straightening system. FIG. 7 is a schematic graph illustrating control of straightening speed of a straightening device depending on a material length in the straightening system.

Referring to FIGS. 3 to 7, a straightening system according to an exemplary embodiment of the present disclosure may include a cooling device 100 for spraying a cooling fluid in a predetermined pattern with respect to a plurality of regions of a material M, divided in a width direction, to cool a material passed through the rolling mill 20 after the material is heated by a heating furnace, a straightening device 50 for straightening the material M passed through the cooling device 100, a flatness measuring system 83 for measuring flatness of the material M passed through the cooling device 100, and a controller 90 for receiving data of the flatness of the material M from the flatness measuring system 83 and controlling at least one of the cooling device 100 and the straightening device 50 in response to the received data to enhance the material flatness.

The controller 90 may be operated to store a plurality of pieces of shape pattern data and data for controlling at least one of the cooling device 100 and the straightening device 50 depending on the shape pattern, to recognize the shape pattern of a material through the data received from the flatness measuring system 83, and to control at least one of the cooling device 100 and the straightening device 50.

Here, referring to FIG. 5, the shape pattern of the material may be set to a total wave pattern with an overall wave height (a), an edge wave pattern with a maximum wave height at an edge portion (b), a center wave pattern with a maximum wave height at a central portion in a longitudinal direction (c), a curved pattern rounded in a width direction (d), and a curl pattern with a wound fore-end portion or tail-end portion (e). Here, a shape pattern of the material is not limited thereto and, when there is another shape pattern formed by modifying an actual material, the shape pattern may be added.

The straightening device 50 may be provided as a predetermined straightening device applied to a thick plate processing line and the controller 90 may be provided to control at least one of a straightening roll interval and straightening speed of the straightening device 50 depending on a shape pattern of the material.

That is, the straightening device 50 may preset a straightening roll interval and straightening speed depending on a steel grade, a width, a thickness, or the like of a material and perform a straightening operation. In addition, according to the present disclosure, a shape pattern of a material passed through the cooling device 100 may be recognized, the straightening roll interval and straightening speed of the straightening device 50 may be additionally adjusted depending on the shape pattern, and the straightening operation may be performed to make more accurate straightening.

The controller 90 may receive data from the flatness measuring system 83 at a predetermined time interval and control at least one of the straightening roll interval and straightening speed of the straightening device 50 depending on the shape pattern of the material based on the received data. That is, when the material is long, the material may have a shape pattern that is different for each region in a longitudinal direction. Accordingly, when the shape pattern is different in a longitudinal direction, the controller 90 may perform control to more accurately perform the straightening operation in consideration of this fact.

For example, as shown in FIG. 6, when a fore-end portion of the material is a curved pattern, a central portion of the material is a flat pattern, and a tail-end portion of the material is an edge wave pattern, compared with the preset straightening roll interval "a," the straightening roll interval may be reset in such a way that a straightening roll interval "b," reset at the fore-end portion and the tail-end portion, is narrower than the preset straightening roll interval "a." In the case of straightening speed, compared with a preset straightening roll speed "c," straightening roll speed "d" that is reset at the fore-end portion and the central portion may be reset to be lower than the preset straightening roll speed "c" and the straightening operation may be performed.

According to an exemplary embodiment of the present disclosure, a straightening system may further include a position detection sensor (not shown) for recognizing a position of a fore-end portion and tail-end portion of a material. The position detection sensor may accurately recognize a position of the material to more accurately adjust cooling speed and straightening speed of the material.

For example, the controller 90 may receive data from the position detection sensor and, upon detecting that the fore-end portion of the material is positioned in the straightening device 50 and the tail-end portion of the material is positioned in the cooling device 100, the controller 90 may control the straightening device 50 in such a way that the straightening speed of the straightening device 50 is the same as the cooling speed of the cooling device 100.

That is, as shown in FIG. 7, from a time point "a" when the fore-end portion of the material enters the cooling device 100 to a time point "b" when the tail-end portion of the material is separated from the cooling device 100, straightening speed "B" of the material may be set to be the same as the cooling speed "A".

In more detail, referring to (a) of FIG. 7, the material is long and, in a procedure in which the material is passed through the cooling device 100, the fore-end portion of the material may enter the straightening device 50 and a straightening operation may be performed. In this case, the straightening speed "B" of the straightening device 50 may be set to be the same as the cooling speed "A" to accurately complete a cooling process up to the tail-end portion of the material. If the straightening speed "B" of the material is adjusted to be lower than the cooling speed "A" depending on the shape pattern of the material, the tail-end portion of the material may be excessively cooled and, thus, it may be difficult to ensure desired physical properties of the material.

The controller 90 may receive data from the position detection sensor and, upon detecting that the fore-end portion of the material is positioned in the straightening device 50 and the tail-end portion of the material is separated from the cooling device 100, the controller 90 may control the straightening speed "B" of the straightening device 50 depending on the shape pattern of the material and perform a straightening operation.

That is, referring to (b) of FIG. 6, the material is short, the material is passed through the cooling device 100 and, then, the fore-end portion of the material may enter the straightening device 50 and the straightening operation may be performed. In this case, a cooling process of the material is already completed and, thus, the straightening speed "B" of the straightening device 50 may be adjusted depending on the shape pattern of the material and a straightening operation may be performed.

Furthermore, the controller 90 may control the cooling device 100 to adjust a flow rate of a cooling fluid sprayed in a width direction of the material depending on the shape pattern of the material.

In addition, the straightening system may further include a high-temperature material temperature sensor 81 disposed in an upstream region of the cooling device 100 to measure a temperature of a material entering the cooling device 100 with respect to a width direction, and the controller may control the cooling device 100 to adjust a flow rate of a cooling fluid sprayed in the width direction of the material depending on temperature data in a width direction of the material, received from the high-temperature material temperature sensor 81.

That is, the controller 90 may measure a temperature of the material in a width direction and may perform control to spray cooling fluid at a high flow rate in a region with a relatively high temperature and to spray a small flow rate of a cooling fluid in a region with a relatively low temperature or not to spray a cooling fluid to significantly reduce a temperature deviation of the material in a width direction thereof.

The straightening system may further include a cooled material temperature sensor 82 disposed in a downstream region of the cooling device 100 to measure a temperature of the material passed through the cooling device 100 in a width direction and, when a temperature deviation of the material in a width direction, received from the cooled material temperature sensor 82, is equal to or greater than a predetermined temperature, the controller 90 may reset a flow rate of a cooling fluid to be sprayed onto each divided region of the material in consideration of the temperature deviation and may control the cooling device 100.

That is, the controller 90 may re-measure a temperature of the material passed through the cooling device 100 in a width direction and, when a temperature deviation between highest and lowest temperatures is greater than a temperature deviation for ensuring product quality, the controller 90 may increase a flow rate of a cooling fluid sprayed onto a highest-temperature region to reduce the temperature deviation or may reset a sprayed flow rate of the cooling fluid to reduce a flow rate of the cooling fluid to be sprayed onto a lowest-temperature region.

Based on the configuration, the controller 90 may primarily set a flow rate of a cooling fluid sprayed onto each region through data measured from the high-temperature material temperature sensor 81 in online, receive data measured by the cooled material temperature sensor 82 and, when a temperature deviation of a material in a width direction thereof is equal to or greater than a predetermined temperature, secondarily re-adjust a flow rate of a cooling fluid sprayed onto each region to set an optimum flow rate of a sprayed cooling fluid for significantly reducing the temperature deviation of the material in the width direction thereof.

The straightening system according to an exemplary embodiment of the present disclosure may further include a shape adjusting device 400 disposed in an upstream region of the cooling device 100 to spray a cooling fluid to the material M and to induce modification of a shape of the material M. Here, the controller 90 may store a plurality of pieces of shape pattern data and data for controlling the shape adjusting device 400 depending to the shape pattern and may match the measured shape pattern of the material M and the stored shape pattern to control the shape adjusting device 400.

The shape adjusting device 400 may spray a cooling fluid in a width direction of the material M and may adjust a flow rate of a sprayed cooling fluid to induce modification of a shape of the material M.

In more detail, the shape adjusting device 400 may include an upper shape adjuster 410 disposed in an upper portion of the material M to spray a cooling fluid to an upper surface of the material M and a lower shape adjuster 420 disposed in a lower portion of the material M to spray a cooling fluid to a lower surface of the material M.

Although not shown, the upper shape adjuster 410 and the lower shape adjuster 420 may each include a nozzle for spraying a cooling fluid, a cooling water supplying line for supplying a cooling fluid to the nozzle, and a control valve disposed in the cooling water supplying line to control a flow rate of a cooling fluid supplied to the nozzle. Here, the cooling water supplying lines connected to the upper shape adjuster 410 and the lower shape adjuster 420 may be separated from each other and the control valves may be separately provided to separately adjust a sprayed cooling fluid through the upper shape adjuster 410 and the lower shape adjuster 420.

The shape adjusting device 400 may spray a cooling fluid in a width direction of the material M at a predetermined pressure to block the fluid sprayed onto the material M from the cooling device 100 from flowing toward the heating furnace. That is, the shape adjusting device 400 may simultaneously function as a remaining water block device for preventing remaining water remaining in the material M from flowing to external equipment.

The controller 90 may control at least one of the upper shape adjuster 410 and the lower shape adjuster 420 depending on a shape pattern of the material M to spray a cooling fluid to at least one of upper and lower surfaces of the material M.

For example, when the material M, passed through the cooling device 100, is formed in a curved pattern with a fore-end portion and a tail-end portion which are inclined downward in a longitudinal direction of the material and is also formed in a curved pattern with opposite lateral ends inclined downward in a width direction of the material, if both the upper shape adjuster 410 and the lower shape adjuster 420 of the shape adjusting device 400 are controlled to spray a cooling fluid to the upper and lower surfaces of the material M, the curved patterns may remain in the longitudinal and width directions of the material M but a maximum height of a waveform may be reduced.

As described above, when the material M is formed in a curved pattern with the fore-end portion and the tail-end portion which are inclined downward in the longitudinal direction of the material M and is formed in a curved pattern with the opposite lateral ends inclined downward in the width direction of the material, if only the upper shape adjuster 410 is operated to spray a cooling fluid only to the upper surface formed of the material M, the material M may be formed in a curved pattern with a higher waveform in the longitudinal and width directions. When only the lower shape adjuster 420 is operated to only spray a cooling fluid onto the lower surface of the material, the material may be formed in a curved pattern, a wave height of which is lowered in a longitudinal direction and a wave height of which is much higher in a width direction.

As such, when whether a cooling fluid is sprayed onto upper and lower surfaces of the material M is determined depending on a shape pattern of the material M passed through the cooling device 100 and data is feedbacked to the shape adjusting device 400, the data may be applied to the material M that later enters the cooling device 100 to enhance the flatness of the material M.

The controller 90 may set a flow rate of a cooling fluid to be sprayed onto upper and lower surfaces of the material M depending on the shape pattern of the material M and may control a flow rate of a sprayed cooling fluid of the upper shape adjuster 410 and the lower shape adjuster 420.

For example, flow rates of cooling fluids to be sprayed onto the upper and lower surfaces of the material M need to be the same, the controller 90 may set a ratio of a flow rate of a cooling fluid sprayed by the upper shape adjuster 410 and a flow rate of a cooling fluid sprayed by the lower shape adjuster 420 to 8:10. This is because a predetermined flow rate of a cooling fluid sprayed onto the upper surface of the material M remains on the material M and, thus, in consideration of this flow rate, a flow rate of the cooling fluid sprayed onto the upper surface of the material M is set to be lower than a flow rate of the cooling fluid sprayed onto the lower surface. In this case, a flow rate ratio of cooling fluids sprayed onto the upper and lower surfaces of the material M may be differently set, depending on a size of the material M.

According to an exemplary embodiment of the present disclosure, the controller 90 of the straightening system may control at least one of rolling force and rolling speed of the rolling mill 20 depending on the shape pattern of the material M. That is, the controller 90 may recognize the shape pattern of the material M, may adjust rolling force and rolling speed of the rolling mill 20, which initially affect the shape pattern of the material M and, then, may perform rolling to prevent the material M from being deformed into a specific shape pattern.

As such, the cooling device 100 for separately spraying a cooling fluid to a predetermined region in a width direction of a material is described below in more detail.

FIG. 8 is a perspective view of a cooling device of the straightening system. FIG. 9 is a schematic perspective view of a plurality of group nozzles in a cooling device of the straightening system. FIG. 10 is a schematic front view of an operating state of a cooling device in the straightening system. FIG. 11 is a schematic perspective view obtained by enlarging a portion of a cooling device of the straightening system. FIG. 12 is a schematic perspective view obtained by taking a mask of a cooling device in the straightening system. FIGS. 13 and 14 are schematic cross-sectional views showing a state in which a nozzle is closed and open in a cooling device of the straightening system. FIGS. 15 and 16 are schematic diagrams showing a state in which a cooling fluid is moved through a flow hole of a mask when a nozzle is closed and open in a cooling device of the straightening system.

Referring to FIGS. 8 to 16, the cooling device 100 may include a base frame 200 connected to an external cooling fluid supplying line 10 and a nozzle assembly 300 disposed in the base frame 200 to spray a cooling fluid in a predetermined pattern with respect to a plurality of regions z divided in a width direction of the material to significantly reduce a temperature deviation of the material M in the width direction thereof.

The nozzle assembly 300 may be disposed in the base frame 200 to receive a cooling fluid, a nozzle 320 may include a plurality of rows and columns, a predetermined number of the nozzles 320 may form a group and may be divided into a plurality of group nozzles G, and the group nozzles G may be closed and open to spray a cooling fluid to a predetermined region.

That is, the nozzle 320 may be provided in a plurality of number and a predetermined number of the nozzles 320 may be used as the group nozzles G and may be simultaneously open to simultaneously spray a cooling fluid to a predetermined region Z and, thus, may stabilize a supplied flow rate within a relatively short time period to stably follow a profile of an indicated flow rate. Here, the cooling fluid may be provided as cooling water and, when the nozzle 320 is open, the cooling fluid is dropped to a high-temperature material according to free fall due to self load of the cooling fluid to cool the material.

The nozzle assembly 300 may open at least one of the plurality of group nozzles G to selectively spray a cooling fluid to the specific region Z.

In more detail, when the nozzle assembly 300 is disposed in the width direction of the high-temperature material M and the group nozzles G of the nozzle assembly 300 are arranged in one column in the width direction of the high-temperature material M, a specific group nozzle of the plurality of group nozzles G may be selectively open to cool only the specific region Z of the high-temperature material M.

For example, as shown in FIG. 10, when 10 group nozzles are arranged, based on a left side of the drawing, group nozzles #2, #4, #7, and #9 may be closed and group nozzles #1, #3, #5, #6, #8, and #10 may be open and, in this case, the group nozzles may be operated to spray a cooling fluid.

Based on the configuration, a cooling fluid may be selectively sprayed onto a specific region in a width direction of the high-temperature material M and, thus, a temperature deviation in a width direction may be significantly reduced. That is, two and three group nozzles in a position corresponding to a high-temperature region of the high-temperature material M, to which a large flow rate of a cooling fluid needs to be sprayed, may be open to spray cooling fluid at a high flow rate and one group nozzle in a position corresponding to a relatively low-temperature region may be open to spray cooling fluid at a low flow rate or may be closed so as not to spray a cooling fluid, thereby significantly reducing a temperature deviation in a width direction.

Furthermore, #1 and #10 group nozzles positioned at opposite ends of the plurality of group nozzles may always be open while a cooling device is operated to discharge a predetermined flow rate of a cooling fluid to prevent water hammering in a region in which the cooling fluid is stored and supplied.

The base frame 200 may include a support frame 210 including the nozzle assembly 300 provided therein, a storage pipe 220 disposed in the support frame 210 and connected to the cooling fluid supplying line 10 to store a cooling fluid, and a supplying pipe 230 connected between the nozzle assembly 300 and the storage pipe 220 to supply a cooling fluid to the nozzle assembly 300.

That is, the storage pipe 220 may be connected to the cooling fluid supplying line 10 to receive a cooling fluid and may be formed to pre-store a larger amount of a cooling fluid than an amount of a cooling fluid stored in the nozzle assembly 300 to smoothly supply a cooling fluid to the nozzle assembly 300. In addition, the supplying pipe 230 may include a valve (not shown) and, when a cooling fluid stored in the nozzle assembly 300 is equal to or lower than a predetermined amount, the valve may be operated to supply a cooling fluid.

The nozzle assembly 300 may include a housing 310 for storing a cooling fluid, a plurality of nozzles 320 protruding into the housing 310 and including a through hole formed in a longitudinal direction thereof to spray out of a cooling fluid, a plurality of masks 330 disposed on the respective group nozzles to close and open the respective group nozzles, and a plurality of actuators 340 disposed in the housing 310 to separately move the plurality of masks 330 in upward and downward directions.

The housing 310 may be provide with a hollow portion to store a predetermined amount of a cooling fluid or more in the hollow portion and may be provided with a horizontal lower surface on which the plurality of nozzles 320 are formed.

The housing 310 may be long in such a way that the group nozzles are arrange in a line. In this case, the housing 310 may be arranged in a width direction of a high-temperature material to selectively open the plurality of group nozzles and to supply a cooling fluid to a specific region in a width direction.

The nozzles 320 may be arranged in a plurality of rows and columns in the housing 310 to spray a cooling fluid to a predetermined region. The nozzle 320 may be formed to protrude into the housing 310 from the lower surface of the housing 310 and the through hole may be formed in a longitudinal direction to spray a cooling fluid to the outside. That is, when the mask 330 closes the nozzle 320, an end portion of the protruding nozzle 320 may be pressurized and closed. Leakage of a cooling fluid may be more effectively prevented. Here, a shape of the nozzle 320 is not limited thereto and may have any shape as long as a cooling fluid is simultaneously sprayed onto a predetermined region.

With regard to the plurality of nozzles 320, a predetermined number of nozzles may form a group and may be separated to a plurality of group nozzles. For example, when the nozzles 320 are formed in the housing 310 in eight rows and eighty columns and eight vertical nozzles 320 and eight horizontal nozzles 320 form one group nozzle, a total of ten group nozzles may be separated. In this case, the masks 330 may simultaneously close and open one group nozzle, that is, eight vertical nozzles 320 and eight horizontal nozzles 320.

The mask 330 may be disposed in the housing 310 and may be moved in upward and downward directions and may be operated to simultaneously close and open the plurality of nozzles 320, i.e., one group nozzles that protrude into the housing 310 to simultaneously spray or block a cooling fluid through the plurality of nozzles 320. In this case, the mask 330 may be moved in upward and downward directions according to driving of the actuator 340 disposed in the housing 310. In this case, when the mask 330 is moved to open the nozzle 320 in a state in which the nozzle 320 is closed, an interval between the mask 330 and the nozzle 320 may be adjusted to control a flow rate of a sprayed cooling fluid.

In more detail, the mask 330 may include a base plate 331 with a plurality of flow holes h through which a cooling fluid flows and having one surface coupled to the actuator 340, and an elastic member 332 disposed on the other surface of the base plate 331, having holes formed in positions corresponding to the flow holes h of the base plate 331, and for sealing the through holes of the nozzle 320 when the nozzles 320 are closed.

The base plate 331 may be formed with an area for entirely covering the plurality of nozzles 320 disposed in the housing 310 and may include the flow holes h except for a region for closing the nozzle 320 to significantly reduce resistance due to a cooling fluid when the base plate 331 is moved in upward and downward directions. That is, the base plate 331 has a predetermined area and, when the base plate 331 is moved in upward and downward directions in the housing 310, resistance due to a cooling fluid is greatly generated due to a wide surface area and, thus, response to a control signal is delayed and it is difficult to follow a profile of an indicated flow rate. Therefore, the plurality of flow holes h may be formed to ensure high response speed, thereby significantly reducing flow resistance generated during movement in upward and downward directions.

In a state in which the nozzle 320 is closed, when the base plate 331 is moved upward to open the nozzle 320, a large amount of a cooling fluid may flow through the plurality of flow holes h formed in the base plate 331, as shown in FIG. 15, and, thus, resistance applied to the base plate 331 may be reduced to prevent the base plate 331 from being deformed. When the base plate 331 is moved to close the nozzle 320 after a predetermined time period elapses, a large amount of a cooling fluid may also flow through the plurality of flow holes h to reduce resistance applied to the base plate 331, as shown in FIG. 16.

The base plate 331 of the mask 330 may include a coupler 333 that protrudes from the center of one surface of the base plate 331 and coupled to the actuator 340, and a reinforcing rib 334 formed to extend to a circumference of the base plate 331 from the coupler 333 to prevent the base plate 331 from being deformed.

That is, the base plate 331 has a wide surface area and, thus, when being moved in upward and downward directions, the base plate 331 may be bent and deformed at four front, rear, left, and right ends based on the coupler 333 and, thus, when being used for a long time, there is a problem in that the base plate 331 is damaged due to fatigue load accumulating on the base plate 331. Accordingly, the reinforcing rib 334 may be formed to extend to the circumference of the base plate 331 from the coupler 333 formed at the center of the base plate 331 to reinforce bending load. In this case, the reinforcing rib 334 may be welded to the coupler 333 and one surface of the base plate 331.

Furthermore, when the masks 330 are arranged in a line in the housing 310 to open and close the nozzles 320, the reinforcing rib 334 may be formed on the base plate 331 in the same direction as a direction in which the mask 330 is disposed. That is, when the mask 330 is moved in upward and downward directions, a cooling fluid in the housing 310 may be pressed to opposite sides due to movement of the mask 330 and, thus, the pushed cooling fluid may be applied to the adjacent mask 330 as a large load to damage the adjacent mask 330. Accordingly, the reinforcing rib 334 may be formed in the same direction as a direction in which the mask 330 is disposed to reinforce a region on which load applied to the base plate 331 is concentrated.

FIGS. 17 and 18 are schematic cross-sectional views showing a state in which a nozzle is closed and open using a mask in a cooling device of the straightening system according to another exemplary embodiment of the present disclosure.

Referring to FIGS. 17 and 18, the elastic member 332 of the mask 330 may further include a protrusion 332*a* that is formed to protrude at a portion of the elastic member 332, which is closely positioned to the nozzle 320, to pressurize and seal the nozzle 320. That is, the elastic member 332 may further include the protrusion 332*a* that protrudes toward the nozzle 320 in a region of the elastic member 332, which is closely positioned to the nozzle 320, to seal the nozzle 320 not to leak a cooling fluid when the nozzle 320 is closed. In this case, the protrusion 332*a* may be formed with at least larger diameter than a diameter of the nozzle 320.

FIG. 19 is a schematic perspective view obtained by taking a mask in a cooling device of the straightening system according to another exemplary embodiment of the present disclosure.

Referring to FIG. 19, the reinforcing rib 334 included in the base plate 331 may include a plurality of first ribs 334*a* that are formed to extend to each corner of the base plate 331 from the coupler to support modification of the base plate 331 with relatively high rigidity, and second ribs 334*b* disposed on the plurality of first ribs 334*a* to connect between the plurality of first ribs 334*a*. Here, a shape and structure of the reinforcing rib 334 are not limited thereto and the reinforcing rib 334 may be provided with any shape to prevent the base plate 331 from being bent.

FIG. 20 is a schematic diagram illustrating a state in which a mask is replaced in the cooling device. FIG. 21 is a schematic diagram illustrating a state in which a mask is detached from and attached to the cooling device.

Referring to FIGS. 20 and 21, the mask 330 may be detachably provided to the actuator 340. That is, the coupler 333 formed on the base plate 331 and an operating rod of the actuator 340 may be detachably provided. This is to easily replace only the mask 330 when the mask 330 is not capable of accurately close and open the nozzle 320 because of deformation of the base plate 331, corrosion of the elastic member 332, etc. due to long-time use. In this case, as shown in FIG. 20, the actuator 340 and the coupler 333 may be coupled to each other via a pin 360 to more simply couple and decouple the actuator 340 and the coupler 333. Here, a component for coupling and decoupling the actuator 340 and the base plate 331 is not limited thereto and various mechanically coupling methods may be applied.

To this end, the housing 310 may further include a through portion 311 that is connected to the outside and is formed in a size to allow the mask 330 to be extracted and inserted, and a door portion 350 for opening and closing the through portion 311 of the housing 310. That is, the door portion 350 may close the through portion 311 of the housing 310 and, when it is necessary to check a state of an internal portion of the housing 310 or to replace the mask 330, the door portion 350 may be open to open the internal portion of the housing 310. In this case, the door portion 350 may be rotatably coupled to the housing 310 to close and open the through portion 311 or may be detachably provided to the through portion 311 to close and open the through portion 311.

FIG. 22 is a schematic flowchart of a straightening method according to an exemplary embodiment of the present disclosure.

Referring to FIG. 22, the straightening method according to an exemplary embodiment of the present disclosure may include a shape adjusting step S100 for spraying a cooling fluid to a material entering a cooling device after being passed through a rolling mill and inducing modification of a shape of the material by a shape adjusting device, a flatness measuring step S200 for measuring flatness of a material cooled by the cooling device, a shape pattern recognizing step S300 for recognizing a shape pattern of the material from flatness data of the material, a shape adjusting device controlling step S400 for controlling the shape adjusting device by the controller depending on the recognized shape pattern of the material, a straightening device controlling step S500 for controlling a straightening device by the controller depending on the shape pattern of the material, and a cooling device controlling step S600 for controlling the cooling device by the controller depending on the shape pattern of the material.

Here, the shape adjusting device may include an upper shape adjuster disposed on the material to spray a cooling fluid to an upper surface of the material, and a lower shape adjuster disposed below the material to spray a cooling fluid to a lower surface of the material.

Based on the configuration, in the shape adjusting device controlling step S400, the controller may operate at least one of the upper shape adjuster and the lower shape adjuster to spray a cooling fluid to at least one of the upper and lower surfaces of the material depending on the shape pattern of the material.

In the shape adjusting device controlling step S400, a flow rate of the cooling fluid sprayed onto the upper and lower surfaces of the material may be set depending on the shape pattern of the material and an amount of a sprayed cooling fluid of the upper shape adjuster and the lower shape adjuster may be controlled.

In the shape adjusting device controlling step S400, the shape pattern of the material may be feedbacked and the shape adjusting device may be controlled in real time to enhance flatness of the material.

FIG. 23 is a schematic flowchart of a straightening device controlling step of a straightening method according to an exemplary embodiment of the present disclosure.

Referring to FIG. 23, in the straightening device controlling step S500, at least one of a straightening roll interval and straightening speed of the straightening device may be controlled depending on the shape pattern of the material. The straightening device controlling step S500 may include a material position detecting step for recognizing positions of a fore-end portion and a tail-end portion of the material.

In more detail, when the positions of the fore-end portion and the tail-end portion of the material may be recognized (S520) and it may be detected that the fore-end portion of the material is positioned in the straightening device and the tail-end portion of the material is positioned in the cooling device (YES of S530), the controller may control the straightening device in such a way that the straightening speed of the straightening device is the same as the cooling speed of the cooling device (S510).

In addition, when it may be detected the fore-end portion of the material is positioned in the straightening device and the tail-end portion of the material is separated from the cooling device (NO of S530), the controller may control straightening speed of the straightening device depending on the shape pattern of the material (S540).

That is, when the fore-end portion of the material enters the straightening device and the tail-end portion of the material is still cooled in the cooling device, the straightening speed of the straightening device may be controlled to be the same as the cooling speed of the cooling device and, when the tail-end portion of the material is separated from the cooling device and a cooling process is terminated, the straightening speed of the straightening device may be controlled to be adjusted depending on the shape pattern of the material.

Here, the controller may initially set the straightening speed of the straightening device to be the same as the cooling speed of the cooling device (S510), may recognize positions of the fore-end portion and the tail-end portion of the material (S520) and, when the tail-end portion of the material is separated from the cooling device in a state in which the fore-end portion of the material is positioned in the straightening device (NO of S530), the controller may control to adjust the straightening speed of the straightening device depending on the shape pattern of the material (S540).

Furthermore, the controller may receive flatness data at a predetermined time interval and control at least one of the straightening roll interval and straightening speed of the straightening device depending on the shape pattern of the material based on the received data. That is, when the material is long, the material may have a shape pattern that is different for each region in a longitudinal direction. Accordingly, when the shape pattern is different in a longitudinal direction, the controller may perform control to more accurately perform the straightening operation in consideration of this fact.

FIG. 24 is a schematic flowchart of a cooling device controlling step of a straightening method according to an exemplary embodiment of the present disclosure.

Referring to FIG. 24, the straightening method may include a sprayed flow rate setting step S620 for dividing a material to predetermined regions in a width direction and setting a flow rate of a cooling fluid to be sprayed onto each divided region of the material depending on temperature with respect to the width direction of the material, and a cooling fluid spraying step S630 for controlling a cooling device formed by a plurality of group nozzles arranged in a line in the width direction of the material to separately spray the cooling fluid to each divided region of the material.

The straightening method may further include a high-temperature material temperature measuring step S610 for measuring temperature of a material entering a cooling device after being passed through a rolling mill with respect to a width direction of the material and, in the sprayed flow rate setting step S620, the flow rate of the cooling fluid to be sprayed onto each divided region of the material may be set depending on temperature data with respect to the width direction of the material.

The straightening method may further include a cooled material temperature measuring step S640 for measuring temperature of a material passed and cooled through the cooling device with respect to the width direction of the material and, when the temperature deviation of the material in the width direction measured in the cooled material temperature measuring step S640, is equal to or higher than predetermined temperature, that is, a temperature deviation range that needs to be satisfied (YES of S650), the method may return to the sprayed flow rate setting step S620 in consideration of the temperature deviation to re-adjust a flow rate of a cooling fluid to be sprayed onto each divided region of the material.

Through this method, a flow rate of a cooling fluid sprayed onto each region may be primarily set through data measured from the high-temperature material temperature measuring step S610 in online and, when a temperature deviation of the material in the width direction is equal to or higher than predetermined temperature from the data measured in the cooled material temperature measuring step S640, a flow rate of the cooling fluid sprayed onto each region may be secondarily re-adjusted to set an optimum flow rate of a cooling fluid for significantly reducing a temperature deviation of the material. That is, the temperature deviation of the material in the width direction may be measured and may be feedbacked, and a flow rate of a cooling fluid to be sprayed may be adjusted in real time, thereby preventing the material from being deformed due to the temperature deviation.

Here, the sprayed flow rate setting step S620 may be set to discharge a predetermined amount of a cooling fluid through group nozzles positioned at opposite lateral ends among the plurality of group nozzles to prevent water hammering in a region in which the cooling fluid is stored and supplied.

The cooling device may be configured to separately close and open the plurality of group nozzles to selectively spray a cooling fluid to a specific region in the width direction of the material.

The cooling device may be configured to control the plurality of group nozzles to be separately closed and open to differently spray a flow rate of a cooling fluid sprayed in the width direction of the material for the respective group nozzles.

Furthermore, according to an exemplary embodiment of the present disclosure, the straightening method may further include a rolling mill controlling step for controlling at least one of rolling force and rolling speed of the rolling mill depending on the shape pattern of the material. That is, the shape pattern of the material may be recognized, rolling force and rolling speed of the rolling mill 20, which initially affect the shape pattern of the material M, may be adjusted and, then, rolling may be performed to prevent the material from being deformed into a specific shape pattern.

While exemplary embodiments have been shown and described above, it will be apparent to those skilled in the art that modifications and variations could be made without departing from the scope of the present disclosure as defined by the appended claims.

The invention claimed is:

1. A straightening system comprising:

a cooling device configured to spray a cooling fluid in a predetermined pattern with respect to a plurality of regions of a material, divided in a width direction, to cool the material that is heated in a heating furnace and then passes through a rolling mill;

a straightening device configured to straighten the material passed through the cooling device;

a flatness measuring system configured to measure flatness of the material passed through the cooling device;

a controller configured to receive data of the flatness of the material from the flatness measuring system, to recognize a shape pattern of the material through the data received from the flatness measuring system, and to control the cooling device in response to the shape pattern to enhance the flatness of the material; and a position detection sensor configured to recognize positions of a fore-end portion and a tail-end portion of the material, wherein the controller controls at least one of a straightening roll interval and straightening speed of the straightening device depending on the shape pattern of the material, and wherein the controller receives data from the position detection sensor, and when it is detected that the fore-end portion of the material is positioned in the straightening device and the tail-end portion of the material is positioned in the cooling device, the controller controls the straightening device in such a way that straightening speed of the straightening device is the same as the cooling speed of the cooling device.

2. The straightening system of claim 1, wherein the controller stores data for controlling the cooling device based on a plurality of the shape patterns, and matches the recognized shape pattern of the material and a stored shape pattern included in the data to control the cooling device.

3. The straightening system of claim 2, wherein the controller controls the cooling device to adjust a flow rate of the cooling fluid sprayed in the width direction of the material, depending on the shape pattern of the material.

4. The straightening system of claim 3, wherein the cooling device includes:

a base frame connected to an external cooling fluid supplying line; and a nozzle assembly disposed on the base frame and configured to spray the cooling fluid in the predetermined pattern with respect to the plurality of divided regions, in the width direction of the material, wherein the nozzle assembly is configured with nozzles arranged in a plurality of rows and columns, a predetermined number of nozzles form a group and are divided into a plurality of group nozzles, and the group nozzles are closed and open to spray the cooling fluid to a predetermined region.

5. The straightening system of claim 1, wherein the controller stores data for controlling the straightening device based on a plurality of the shape patterns, and matches the recognized shape pattern of the material and a stored shape pattern included in the data to control the straightening device.

6. The straightening system of claim 5, wherein the controller receives data from the flatness measuring system at a predetermined time interval.

7. The straightening system of claim 1, further comprising a shape adjusting device disposed in an upstream region of the cooling device and configured to spray the cooling fluid to the material to induce shape modification of the material.

8. The straightening system of claim 7, wherein the controller stores data for controlling the shape adjusting device based on the shape pattern, and matches the recognized shape pattern of the material and a stored shape pattern included in the data to control the shape adjusting device.

9. The straightening system of claim 8, wherein the shape adjusting device sprays the cooling fluid in the width direction of the material and adjusts a flow rate of the sprayed cooling fluid to induce shape modification of the material.

10. The straightening system of claim 9, wherein the shape adjusting device includes:

an upper shape adjuster disposed in an upper portion of the material and configured to spray the cooling fluid to an upper surface of the material; and a lower shape adjuster disposed in a lower portion of the material and configured to spray the cooling fluid to a lower surface of the material.

11. The straightening system of claim 10, wherein the controller operates at least one of the upper shape adjuster and the lower shape adjuster depending on the shape pattern of the material and performs control to spray the cooling fluid to at least one of the upper and lower surfaces of the material.

12. The straightening system of claim 11, wherein the controller sets the flow rate of the cooling fluid to be sprayed onto the upper and lower surfaces of the material depending on the shape pattern of the material and controls the flow rate of the sprayed cooling fluid of the upper and lower shape adjusters.

13. A straightening system comprising;

a cooling device configured to spray a cooling fluid in a predetermined pattern with respect to a plurality of regions of a material, divided in a width direction, to cool the material that is heated in a heating furnace and then passes through a rolling mill;

a straightening device configured to straighten the material passed through the cooling device;

a flatness measuring system configured to measure flatness of the material passed through the cooling device;

a controller configured to receive data of the flatness of the material from the flatness measuring system, to recognize a shape pattern of the material through the data received from the flatness measuring system, and to control the cooling device in response to the shape pattern to enhance the flatness of the material; and a position detection sensor configured to recognize positions of a fore-end portion and a tail-end portion of the material, wherein the controller controls at least one of a straightening roll interval and straightening speed of the straightening device depending on the shape pattern of the material, and wherein the controller receives data from the position detection sensor, and when it is detected that the fore-end portion of the material is positioned in the straightening device and the tail-end portion of the material is separated from the cooling device, the controller controls the straightening speed of the straightening device depending on the shape pattern of the material.

* * * * *